US010206843B2

(12) United States Patent
Hiebert

(10) Patent No.: US 10,206,843 B2
(45) **Date of Patent: *Feb. 19, 2019**

(54) PATIENT POSITIONING SYSTEM

(71) Applicant: HUG-U-VAC Surgical Positioning Systems, Inc., Salem, OR (US)

(72) Inventor: Eugene Lloyd Hiebert, Salem, OR (US)

(73) Assignee: HUG-U-VAC Surgical Positioning Systems, Inc., Salem, OR (US)

( * ) Notice: Subject to any disclaimer, the term of this patent is extended or adjusted under 35 U.S.C. 154(b) by 993 days.

This patent is subject to a terminal disclaimer.

(21) Appl. No.: 14/125,699

(22) PCT Filed: Apr. 16, 2013

(86) PCT No.: PCT/US2013/036735

§ 371 (c)(1),
(2) Date: Dec. 12, 2013

(87) PCT Pub. No.: WO2013/162945

PCT Pub. Date: Oct. 31, 2013

(65) Prior Publication Data

US 2015/0007828 A1 Jan. 8, 2015

Related U.S. Application Data

(60) Provisional application No. 61/636,848, filed on Apr. 23, 2012, provisional application No. 61/668,893, filed on Jul. 6, 2012.

(51) Int. Cl.
*A61G 13/00* (2006.01)
*A61G 13/04* (2006.01)
(Continued)

(52) U.S. Cl.
CPC ..... *A61G 13/1265* (2013.01); *A61G 7/005* (2013.01); *A61G 13/0072* (2016.11);
(Continued)

(58) Field of Classification Search
CPC ..... A61F 5/3769; A61F 5/3776; A61F 5/37; A61G 13/1235; A61G 13/1255;
(Continued)

(56) References Cited

U.S. PATENT DOCUMENTS 3,158,875 A * 12/1964 Fletcher ..... A61G 1/01 5/627
3,212,497 A 10/1965 Dickinson
(Continued)

FOREIGN PATENT DOCUMENTS

WO WO 2011-157863 12/2011

OTHER PUBLICATIONS

Augustine Biomedical & Design; "Hot Dog®," http://vetwarming.com/technology.php, 2 pp. (obtained Jan. 31, 2012).
(Continued)

*Primary Examiner* — Kari K Rodriquez
(74) *Attorney, Agent, or Firm* — Klarquist Sparkman, LLP

(57) ABSTRACT

Described herein are exemplary embodiments of patient positioning systems for supporting and positioning a patient in an inclined position during medical treatment, such as in the Reverse Trendelenburg position. Some embodiments comprise a flexible, air-impermeable shell having a torso portion configured to support the patient's torso and secure the positioner to the support surface, an intermediate portion integrally coupled to an inferior end of the torso portion, and a suprapubic portion integrally coupled to an inferior end of the intermediate portion opposite the torso portion and configured to extend along the patient's perineal-pubic
(Continued)

region when the shell is evacuated of air. When evacuated of air, the positioner is configured to hold the patient in an inclined position on an inclined support surface with the patient's head above the patient's hips such that the intermediate and/or suprapubic portions physically block the patient from sliding feet-first down the inclined support surface.

9 Claims, 24 Drawing Sheets

(51) Int. Cl.
*A61G 13/12* (2006.01)
*A61G 15/00* (2006.01)
*A61G 7/005* (2006.01)

(52) U.S. Cl.
CPC ..... *A61G 13/04* (2013.01); *A61G 13/121* (2013.01); *A61G 13/123* (2013.01); *A61G 13/125* (2013.01); *A61G 13/1255* (2013.01); *A61G 13/1275* (2013.01); *A61G 15/005* (2013.01)

(58) Field of Classification Search
CPC ..... A61G 13/1275; A61G 13/123; A61G 13/1265; A61G 13/127; A47C 27/086
See application file for complete search history.

(56) References Cited

U.S. PATENT DOCUMENTS 3,606,885 A * 9/1971 Lund ..... A61B 6/0421 128/870
3,689,945 A 9/1972 Laerdal
3,762,404 A 10/1973 Sakita
4,234,982 A 11/1980 Bez et al.
4,657,003 A 4/1987 Wirtz
4,862,879 A 9/1989 Coombs
4,885,811 A 12/1989 Hayes
4,962,769 A 10/1990 Garcia
4,999,867 A 3/1991 Toivio et al.
5,121,756 A 6/1992 Koledin
5,154,185 A 10/1992 Latimer et al.
5,443,488 A 8/1995 Namenye et al.
D362,913 S 10/1995 Eisenberg et al.
5,586,348 A 12/1996 Toivio et al.
5,621,934 A 4/1997 Olkkonen et al.
5,626,150 A 5/1997 Johnson et al.
5,634,222 A 6/1997 Zwickey
5,647,079 A 7/1997 Hakamium
5,659,908 A 8/1997 Nishino
5,906,205 A 5/1999 Hiebert
5,911,234 A 6/1999 Hirst
5,986,243 A 11/1999 Campf
6,215,111 B1 4/2001 Rock et al.
6,220,620 B1 4/2001 Harroun
6,308,353 B1 * 10/2001 Van Steenburg ... A61F 5/05833 128/845
6,318,372 B1 11/2001 Hiebert
7,319,207 B2 1/2008 Campf et al.
7,610,641 B2 * 11/2009 Frost ..... A61F 5/05825 277/625
7,959,658 B2 6/2011 Fields et al.
8,555,890 B2 10/2013 Hiebert
2005/0060806 A1 3/2005 Wilkinson
2011/0047706 A1 * 3/2011 Hiebert ..... A61F 5/3769 5/623
2011/0126355 A1 6/2011 Hiebert
2011/0191960 A1 8/2011 Hiebert

OTHER PUBLICATIONS

International Search Report and Written Opinion for International Application No. PCT/US2013/024180, dated May 7, 2013, 9 pages.
International Search Report and Written Opinion for related International Application No. PCT/US2013/036735, dated Sep. 27, 2013, 8 pages.
Natus, Olympic Papoose Boards, http://www.natus.com/index.cfm?pa . . . , 2 pp. (obtained Jun. 17, 2010).
Natus, Olympic Vac-Pac, http://www.natus.com/index.cfm?pa . . . , 2 pp. (obtained Jun. 17, 2010).
Notice of Allowance from the United States Patent & Trademark Office in U.S. Appl. No. 13/364,093 dated Jun. 10, 2013, 12 pages.
Notice of Allowance from the United States Patent & Trademark Office in U.S. Appl. No. 13/744,233 dated Sep. 30, 2013, 11 pages.
Schroer Manufacturing Company, Shor-line® catalog; "Vacu-Positioner," 3 pp., p. G1 (1987).
Schroer Manufacturing Company, Shore-line® catalog; "Vacu-Positioner," p. F20 Sep. 1998).
Sw Med-Source, http://www.swmedsource.com/bean . . . , 6 pp. (obtained Jun. 17, 2010).
ThermoGear™ Inc., http://www.thermogear.com, 1 p. (obtained Jan. 31, 2012).

* cited by examiner

PATIENT POSITIONING SYSTEM

CROSS REFERENCE TO RELATED APPLICATIONS

This is the U.S. National Stage of International Application No. PCT/US2013/036735, filed Apr. 16, 2013, which was published in English under PCT Article 21(2) and claims the benefit of U.S. Provisional Patent Application No. 61/636,848, filed Apr. 23, 2012, and U.S. Provisional Patent Application No. 61/668,893, filed Jul. 6, 2012, which are hereby incorporated by reference in their entirety.

FIELD

This disclosure relates to patient positioning systems for supporting and positioning a patient during medical treatment, such as in an inclined position.

BACKGROUND

Vacuum-actuated positioning aids or devices are utilized in the operating room for positioning patients in horizontal positions, such as the supine, prone and lateral positions. They are frequently used when the patient is in the lateral position, i.e., on his or her side, for a multitude of surgical procedures, such as brain, chest, kidney, shoulder and hip surgery, to name a few. The devices typically comprise a flexible air impervious shell containing small particles or beads which consolidate into a rigid mass when the shell is evacuated.

More specifically, devices of this type typically are filled with thousands of tiny beads. When the device is in the soft (unevacuated) condition, the beads are free to move around so that the device can be molded to the patient's body. When air is removed, atmospheric pressure forces the beads together into a solid mass, positioning and immobilizing the patient in the selected position. Allowing air back into the device returns it to its initial soft condition, ready for re-use. These positioning devices, sometimes referred to as bean bag positioners, typically have a generally square or rectangular shape and in some cases are provided with a U-shaped shoulder cutout located centrally along one edge.

Fabric-style devices also are used for positioning patients during exam or treatment. These devices typically are wrapped around one or more sections of the patient, and include one or more wide canvas flaps with Velcro™ straps. The flaps may be detached and/or unwrapped to allow a particular area of the patient to be selectively exposed for treatment. Foam pads and other positioning aids also are used to reduce pressure points and provide patient support during surgery.

There is a need for an improved positioning system for use in medical treatments where the patient is supported on an inclined surgery table with the head above his feet, as when the patient is in the Reverse Trendelenburg position, for example.

SUMMARY

Described herein are exemplary embodiments of patient positioning systems for supporting and positioning a patient in an inclined position during medical treatment, such as in the Reverse Trendelenburg position.

Some exemplary positioner embodiments comprise a flexible, air-impermeable shell having a torso portion configured to support the patient's torso and secure the positioner to the support surface, an intermediate portion integrally coupled to an inferior end of the torso portion, and a suprapubic portion integrally coupled to an inferior end of the intermediate portion opposite the torso portion and configured to extend along the patient's perineal-pubic region when the shell is evacuated of air. When evacuated, the positioner is configured to hold the patient in an inclined position on an inclined support surface with the patient's head above the patient's hips such that the intermediate and/or suprapubic portions physically block the patient from sliding down the inclined support surface. The intermediate portion can comprise left and right lateral cutout portions that provide relief around the patient's inner thighs to reduce pressure on the patient's obturator nerves. The cutout portions can make the intermediate portion narrower than the both the torso portion and the suprapubic portion. The positioner can further comprise straps that couple the suprapubic region to the torso portion around the patient's thighs or hips to further support the suprapubic region against the patient's perineal-pubic region. In some embodiments, the air valve is positioned at the intermediate portion and along the lower wall of the shell. The torso portion can comprise one or more table straps for securing the positioner to the support surface, and can comprise a plurality of strap patches, each strap patch securing at least one strap to the torso portion.

Exemplary methods of positioning a patient in an inclined position can comprise: securing a torso portion of a evacuatable positioner to an underlying support table with the positioner in unevacuated configuration; positioning a patient with the posterior of the patient's torso against the torso portion of the positioner, an intermediate portion of the positioner adjacent the patient's caudal region, and a suprapubic portion of the positioner extending inferior from the intermediate portion; evacuating the positioner such that the intermediate and suprapubic portions are rigidly positioned between the patient's thighs and along the patient's perineal-pubic region; and/or inclining the support table such that the patient's upper torso is above the patient's hips and the intermediate and suprapubic portions block the patient from sliding down the inclined support table. Some methods can further comprise attaching straps around the patient's thighs or hips before or after the positioner is evacuated, the straps connecting the suprapubic portion with the torso portion to support the suprapubic portion against the weight of the patient in the inclined position. Some methods can further comprise attaching straps of the torso portion around or to the support surface to secure the positioner to the support surface.

The foregoing and other objects, features, and advantages of the invention will become more apparent from the following detailed description, which proceeds with reference to the accompanying figures.

DETAILED DESCRIPTION

Figure 1:
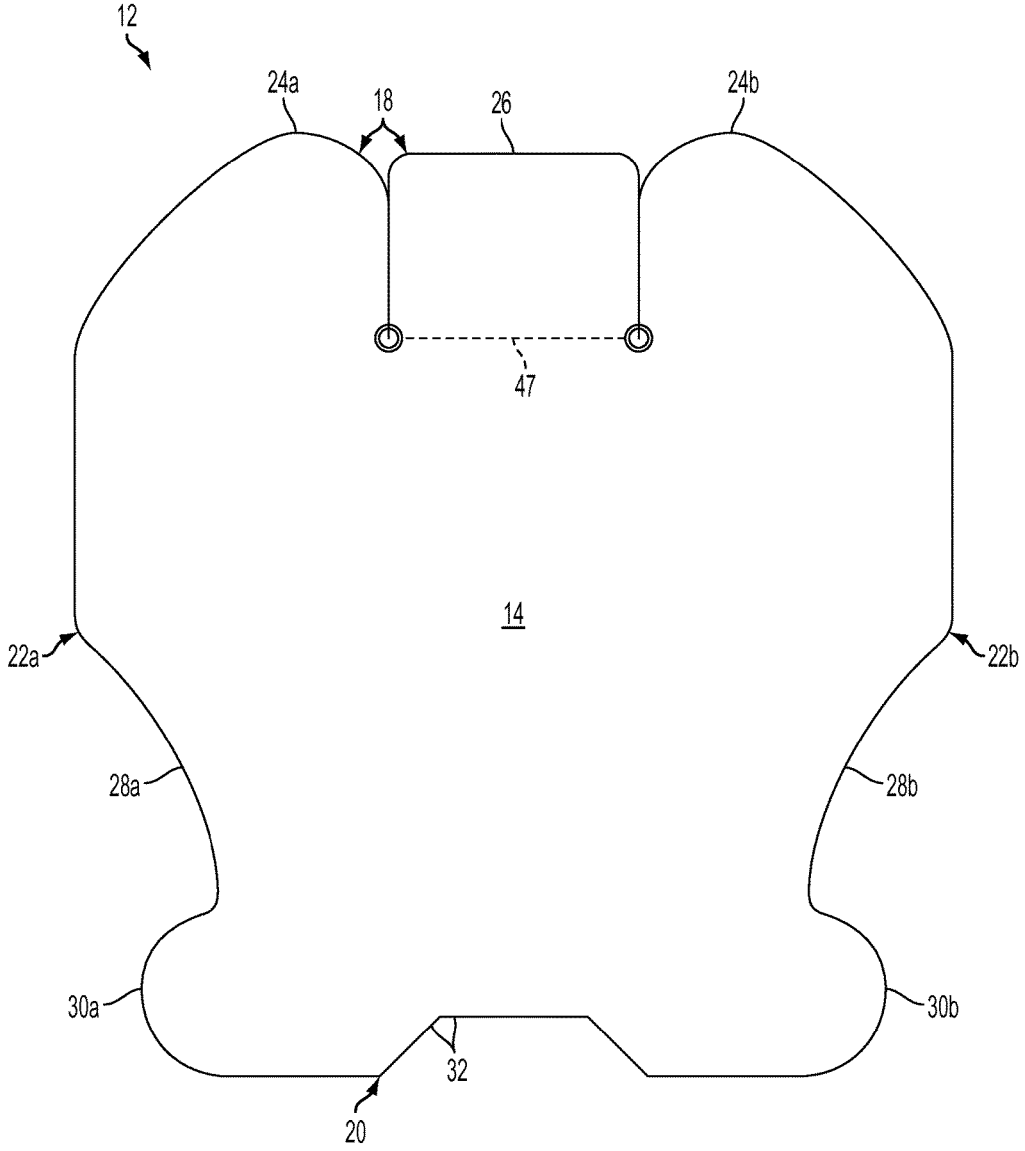
FIG. 1 is a top plan view of an exemplary embodiment of a patient positioning system.
Figure 2:
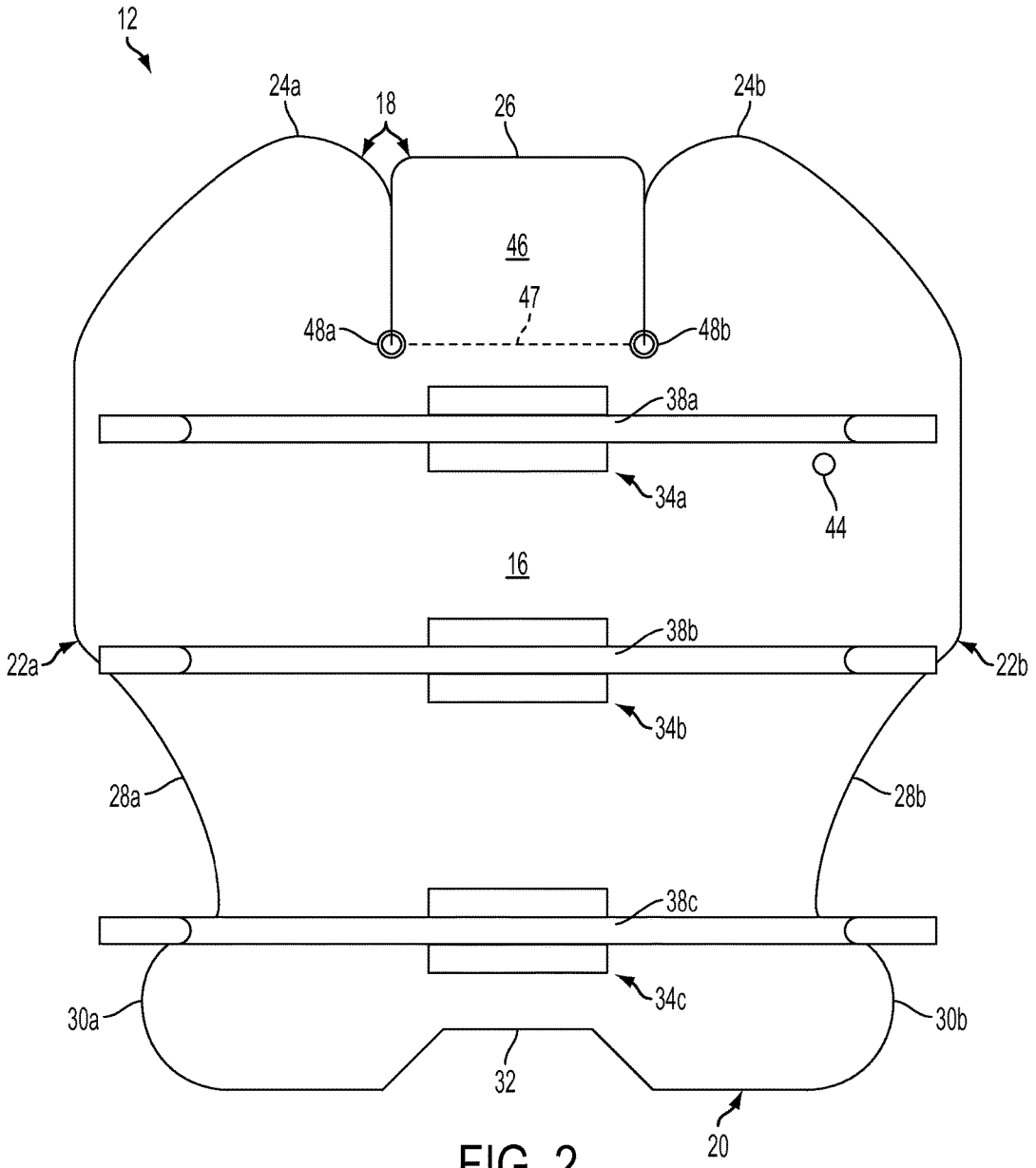
FIG. 2 is a bottom plan view of the embodiment of FIG. 1.

Referring to FIGS. 1 and 2, a first exemplary embodiment of a patient positioning system described herein includes a generally flat bag, or shell, 12 fabricated of flexible, air impermeable material. One exemplary material for the shell 12 is "Rocheux Supreme" polyvinyl waterbed film, distributed by Rocheux International, Inc., Carson, Calif. The Rocheux material has desirable low temperature, tear, heat sealing and flexing qualities, as well as superior hydrostatic resistance which makes it particularly suitable for the present positioning system. It also has good resilience, returning quickly to its prior conformation, thereby holding the patient more securely. It is mildew-, bacteria-, puncture-, and fire-resistant. Exemplary physical properties of the shell 12 are listed in Table 1 below.

TABLE 1

| | | |
|---|---|---|
| Thickness (inches) | 0.024, +5%, −0 | ASTM D-751 |
| Embossing | Plain | |
| Weight (oz./yd.$^2$) | 17.5 (min.) | ASTM D-751 |
| Volatility (% loss) | 1.5 (max) | ASTM D-1203-86, Method B |
| Elongation (%) | 350-360 (min) | ASTM D-882 |
| Elongate change after 14 days × 150° F. (%) | Less than 10 | ASTM D-882 |
| Breaking strength factor (psi) | 44 | ASTM D-882 |
| Tensile change after 14 days × 150° F. (%) | Less than 10 | ASTM D-882 |
| Graves tear (lbs.) | 5.6 (min) | ASTM D-1004 |
| Low temperature (° F.) | −20 (min) | ASTM D-1790 |
| Dimensional stability (%) | −5 (max) | ASTM D-1204 |
| Specific gravity | 1.21-1.23 | ASTM D-792 |
| Mildew resistance | Passes ATCC No. 6275 | California Bureau of Home Furnishings, Bulletin 128 |
| Bacteria resistance | Passes ATCC No. 6538, 4352 | California Bureau of Home Furnishings, Bulletin 128 |
| Hydraulic resistance (psi) | 75 | ASTM D-75 1 |
| Puncture resistance (lbs.) | 34.3 | California Bureau of Home Furnishings, Bulletin 100 |

In another exemplary embodiment, the shell material can comprise various other materials, such as a urethane material. Desirably, the shell material can be RF weldable and/or heat sealable in order to form an air tight seal between two portions of the shell material.

Figure 4:
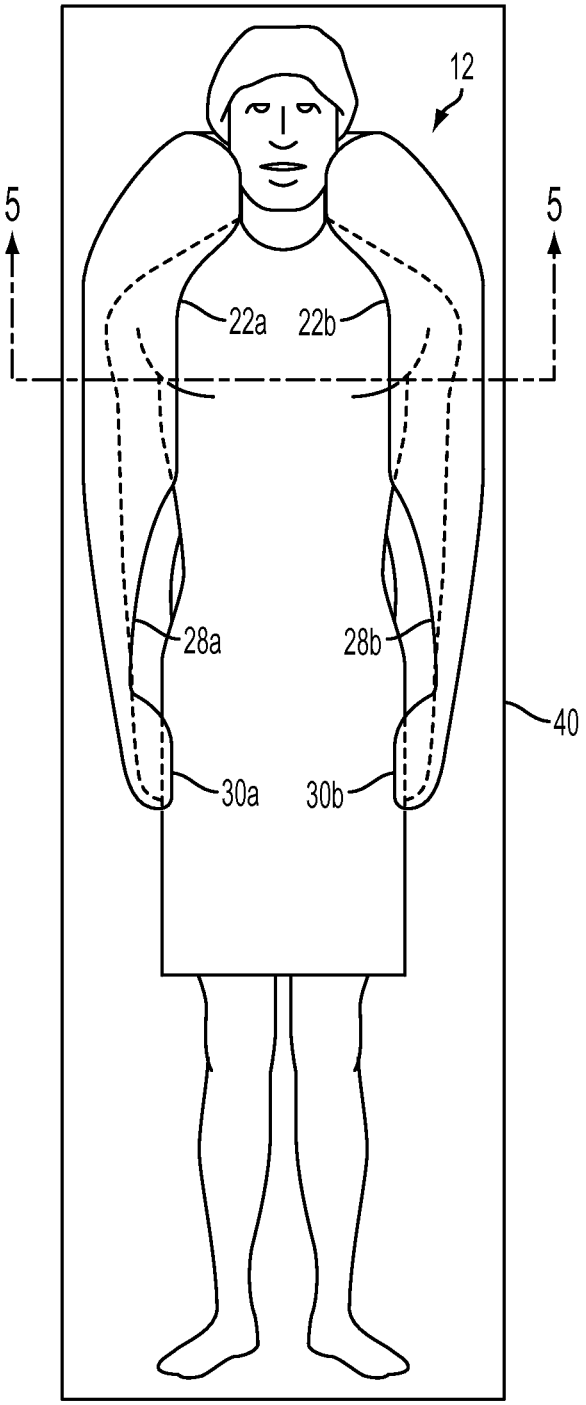
FIG. 4 is a top plan view of the FIG. 1 embodiment, patient and operating table.

The shell 12 can comprise top and bottom opposing walls 14, 16, which can be RF welded, heat sealed or otherwise joined together at their perimeters, such as at upper, lower and lateral edges 18, 20, 22, for strength and airtightness. The shell 12 can have any size and shape, such as for variously sized human patients and/or variously sized animal patients. In one embodiment for an adult human patient, the shell's width at its widest point can be about 42 inches, which exceeds the shoulder width of most patients, and the shell's length at its longest point is about 46 inches, which corresponds generally to the distance between the neck and upper thighs of an average height adult human patient. Thus, when the patient is placed in the supine position on the shell 12, as shown in FIG. 4, the lateral edges 22 can be folded up along the patient's neck, shoulders, arms, hips and upper thighs and packed snuggly against the patient's body to accommodate the natural contours thereof.

Referring again to the exemplary embodiment shown in FIGS. 1 and 2, the upper edge 18 includes two opposed shoulder edge portions 24*a*, 24*b*, and a pillow edge portion 26 located therebetween. Adjacent to the pillow edge portion 26, the shoulder edge portions 24*a*, 24*b* have a relatively tight radius of curvature, such as about 4⅜ inch, allowing the upper edge 18 to be folded upwardly adjacent either side of the patient's head and neck for support. As upper edge 18 extends laterally outwardly toward edges 22, the upper edge retains an arc-like curvature but the radius of curvature of shoulder edge portions 24*a*, 24*b* increases significantly, preferably to about 22 to 23 inches, to expand the width of the shell and allow the upper edge (when folded) to wrap around and at least partially overlie the patient's shoulders to support and immobilize the patient's upper body. The shoulder portions 24*a*, 24*b* of the upper edge 18 terminate where lateral edges 22*a*, 22*b* begin, defining the widest point of the shell.

Lateral edges 22*a*, 22*b* respectively define opposed cut-out portions 28*a*, 28*b*, and opposed projecting wrist supporting portions 30*a*, 30*b*. Wrist supporting portions 30*a*, 30*b* project outwardly to increase the width of the shell in the region proximate the lower edge 20. The width of the shell across the wrist supporting portions can be about 35 inches. The wrist supporting portions may be folded upwardly to provide lateral support for the patient's wrists and hands. They help secure the patient's wrists and hands against the side of the patient's body. The cut out portions 28*a*, 28*b* give the shell a tapered waist and low profile in the vicinity of the patient's arms so as to provide easy access to the patient's wrists and forearms for insertion of an IV, surgical access to the lower lateral abdomen, access for surgical instruments and other purposes.

The lower edge 20 preferably includes a central trapezoid-like cut out 32 to provide perineal access. The cut out 32 preferably conforms to perineal access cut outs sometimes used in operating room table designs to provide access for speculums, rectal instruments and the like.

As shown in FIG. 2, a plurality of strap patches 34*a*, 34*b*, 34*c* (three shown) are secured to the shell by heat sealing, radio frequency welding or other suitable methods to the bottom wall 16. The patches preferably are centered and spaced apart along the shell's longitudinal centerline/axis. Before the strap patches are attached to the bottom wall, elongate fastener straps 38*a*, 38*b*, 38*c* can be attached, such as by sewing or other fixed attachment method, to each patch 34*a*, 34*b*, 34*c*. FIG. 2 shows the ends of each strap doubled back on each other for purposes of illustration. The fastener straps 38*a*, 38*b*, 38*c* (FIGS. 7 and 8) can be used to secure the positioner to an operating table 40 (FIG. 4) on which the positioner and patient are supported. Each strap can include fastening means to fasten one end of the strap to the other or, when looped around an anchor, to itself to safely secure the positioner to the operating table and thereby prevent the positioner from sliding relative to the operating table. The fastening means can comprise any suitable mechanism, such as hook-and-loop fasteners, adjustable buckle style fasteners, clip fasteners, tie down strap fasteners, or other similar means. In some embodiments, each end of the straps may be looped around an operating table side rail, D-ring, or other anchor structure on the table 40, and then secured back to itself using hook-and-loop fasteners or other fastening means. Alternatively, the two ends of each strap may be secured to one another along the underside of the operating table 40, depending on the design of the table. The straps can be formed of ballistic nylon and/or other similar material.

Figure 7:
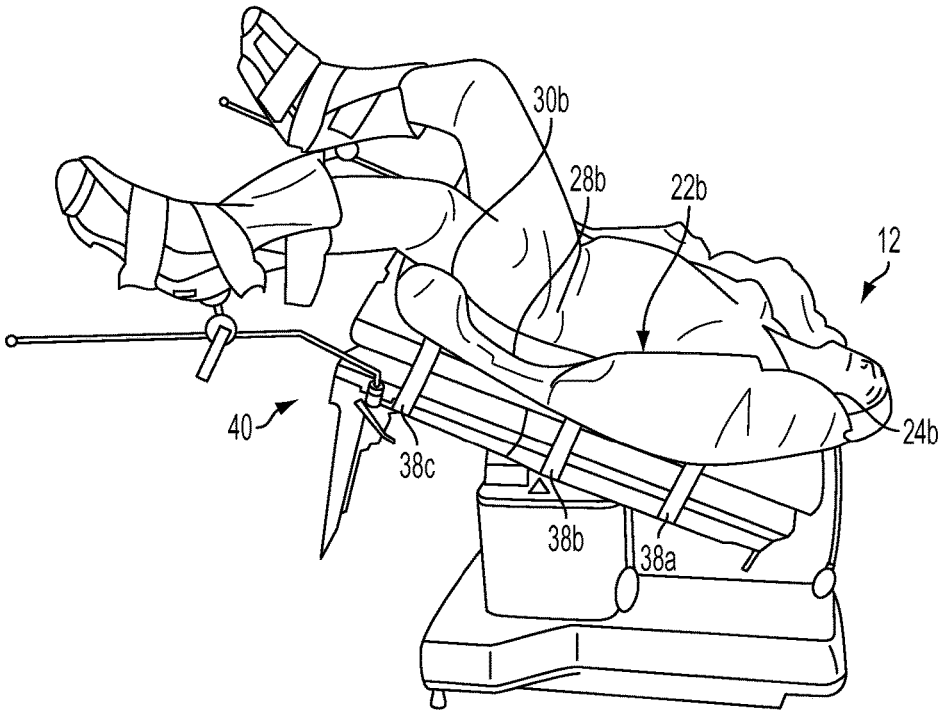
FIG. 7 is a perspective view of the FIG. 1 embodiment and showing a patient in a declined, or Trendelenburg, position as well as Lateral Oblique position with his legs supported by stirrups.

It will be appreciated that once the straps are secured to the operating table, the fixed attachment of the straps to the strap patches 34*a*, 34*b*, 34*c* (and effectively to the shell 12 as well) keep the positioner from sliding laterally on the operating table as, for example, when the table is tilted to place the patient in the Trendelenburg and Lateral Oblique position shown in FIG. 7.

Before walls 14, 16 are joined together to form the enclosed shell 12, the shell is partially filled with a charge of beads 42 (FIG. 5), such as elastically deformable polymeric beads. As used herein, the term "beads" means any small, generally globular, cylindrical, or otherwise rounded bodies. The beads preferably are made of expanded polymeric materials, such as polystyrene or polyvinyl chloride, because of their high mechanical strength, elastic deformability and low specific gravity. Beads 42 of expanded polystyrene are especially preferred. When the shell 12 is in the unevacuated condition, the beads 42 remain loose within the shell such that the upper, lower and lateral edges of the shell can be easily moved or folded up along the side of the patient's neck, shoulder, arms, hips and upper thighs to cradle and support the patient in the selected position. The positioner can be configured to wrap around and overlie at least a portion of the patient's shoulders and upper chest, as shown in FIG. 4.

Figure 6:
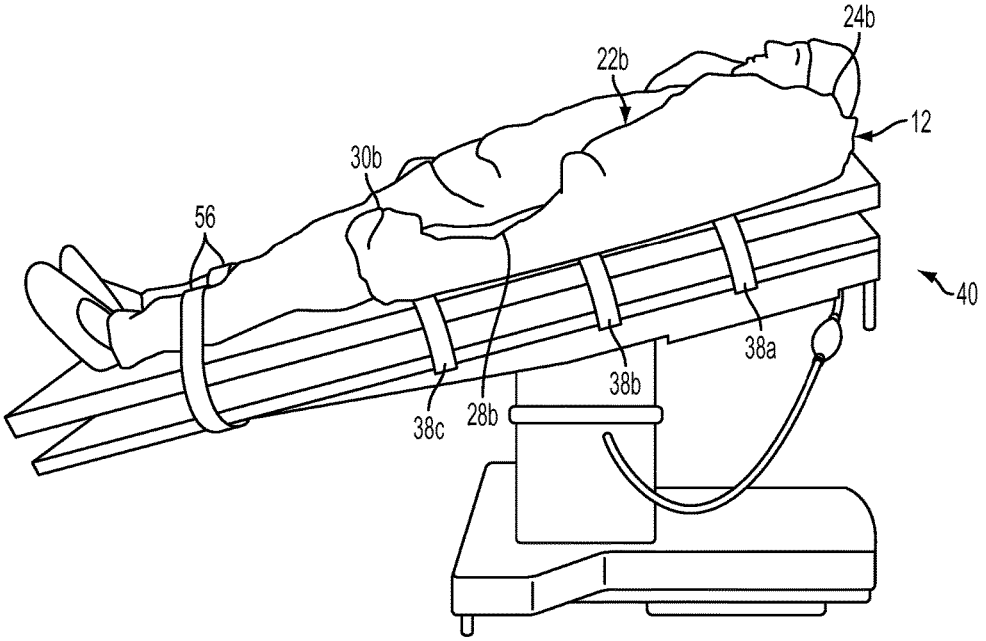
FIG. 6 is a perspective view of the FIG. 1 embodiment and showing a patient in an inclined, or Reverse Trendelenburg, position with his legs extended straight.

The bottom wall 16 of the shell 12 can be provided with a valve 44 (FIG. 2) which communicates with the interior of the shell for evacuating air therefrom. The valve 44 may be identical or similar to the one described in U.S. Pat. No. 5,906,205, the disclosure of which is herein incorporated by reference. The valve may have a male portion with a protruding valve stem and a plastic tube which connects the valve stem to the bottom wall 16 in an airtight manner. The valve also preferably includes a female portion that may be releasably placed over the male portion to depress the valve stem and open the valve to allow ingress or egress of air. When a source of vacuum is attached to the female portion, air is withdrawn from the interior of the shell. This causes the plastic beads 42 to be packed (or to congregate) into a tight configuration, conforming to the patient's body, as shown in FIGS. 6 and 7. When the female portion is removed from the male portion, the valve closes and no air can enter or exit the shell, thereby maintaining the conformity of the shell to the patient's body. When the patient is to be released, the female portion of the valve 44 (without the vacuum hose attached) is placed over the male portion. This opens the valve 44, thereby allowing air to enter the shell and loosening the configuration of the beads so that they reside in a more relaxed, fluid state. This allows the shell to flatten. It will be appreciated that a variety of conventional valves can be used to withdraw air from the shell, maintain the shell in an evacuated state and allow air to reenter the shell.

Figure 3:
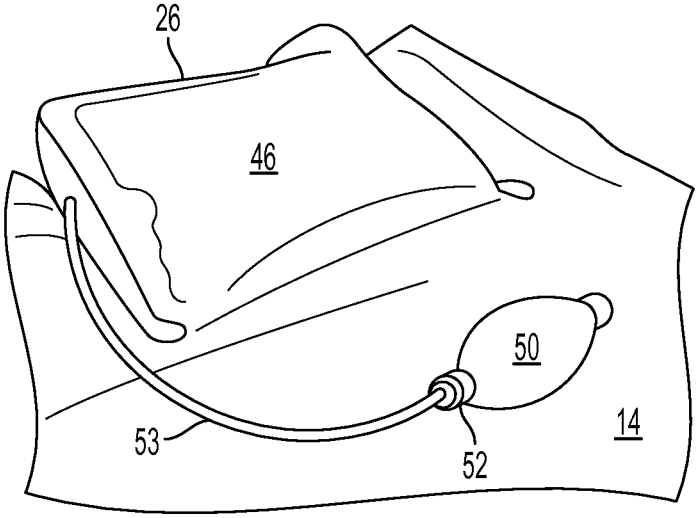
FIG. 3 is a perspective view of one portion of the FIG. 1 embodiment.

As shown in FIGS. 1, 2 and 3, the positioner can include an inflatable pillow 46 which is attached to a cut out portion in the shell located centrally along upper edge 18 between shoulder edge portions 24*a*, 24*b*. There is no fluid communication between the interiors of the shell 12 and pillow 46, each of which constitutes an air impermeable compartment of its own. The pillow has a width of about 12 inches in one embodiment of the present positioning system.

As shown best in FIG. 3, the pillow 46 can be connected to the shell 12 along a hinge line 47 extending between reinforcement grommets 48*a*, 48*b* (FIGS. 1, 2), which preferably is formed by joining the top and bottom walls 14, 16 by heat sealing, radio frequency welding or otherwise. The pillow is free to pivot about the hinge line 47 toward the top wall or bottom wall. The pillow 46 provides support for the patient's head and neck, and may be inflated more or less based on the desired position and orientation for the patient's neck/head during the particular procedure, patient's anatomy and other factors. The pillow may be flipped forward to rest on the top wall 14 to accommodate shorter patients.

The pillow preferably is made of the same material as the shell 12 itself. The pillow may be inflated by a number of conventional techniques, one of which is a hand held inflation bulb 50 (FIG. 3) having a release valve 52 attached to a length of plastic tubing 54 in air-type fluid communication with the interior of the pillow. It will be appreciated that the pillow 46 provides independently adjustable support for the patient's head and neck, allowing the surgeon or nurse to adjust the firmness of the support as well as the position and orientation of the patient's head and neck.

Figure 8:
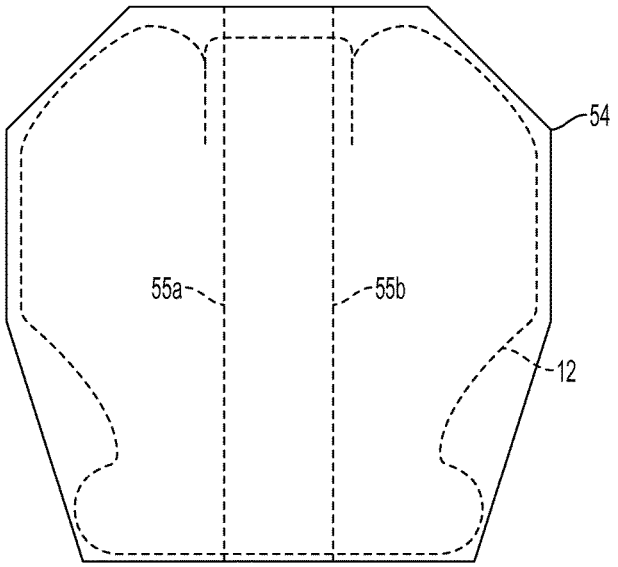
FIG. 8 is a top plan view of an exemplary slipcover used in conjunction with the FIG. 1 embodiment.

Referring to FIG. 8, the present positioning system may be provided with a disposable, waterproof slipcover 54 having a size and shape compatible with covering the top wall 14 of the shell 12, a top layer for fully covering the top wall 14 and bottom layer for partially covering the bottom wall 16. The slipcover 54 is provided with slits 54*a*, 54*b* that provide side pocket openings in the bottom layer of the slipcover, similar to a throw pillow cover. The openings or pockets allow the sides of the positioner to be slipped into the slipcover side pockets such that the top layer of the slipcover covers the top surface of the shell.

Figure 9:
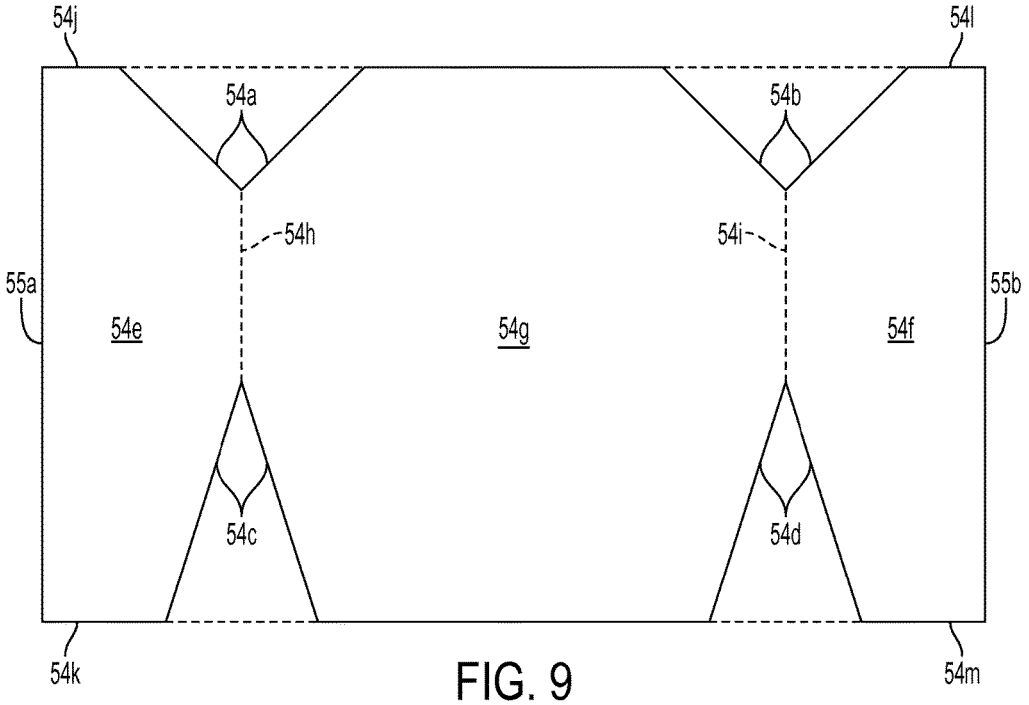
FIG. 9 is a top plan view of an exemplary slipcover material with a pattern indicated thereon.

With reference to FIG. 9, the slipcover is formed from a rectangular piece of fabric or material that is cut along cut lines 54*a*, 54*b*, 54*c*, 54*d*, defining side panels 54*e*, 54*f* and central panel 54*g*. Panels 54*e*, 54*f* are then folded underneath central panel 54*g* along fold lines 54*h*, 54*i*, and the edges 54*a*, edges 54*b*, edges 54*c*, and edges 54*d* are each preferably heat sealed together to create the design shown in FIG. 8. In this way, the panels 54*e*, 54*f* form a pair of laterally opposed, two-layer side pockets with respective portions of central panel 54*g*.

FIG. 4 is a top plan view showing an embodiment of a positioning system supporting the patient in a horizontal position on the operating table 40 during surgery. Air has been evacuated from the shell 12. The positioning system 40 covers the patient's shoulders and provides lateral stabilizing support for the patient's head and neck. Lateral support also is provided for the patient's upper arms, hips and upper thighs, while still providing easy access to the patient's forearms, wrist, and lower lateral abdomen. The pillow 46 supports and orients the back of the patient's head and neck.

Figure 5:
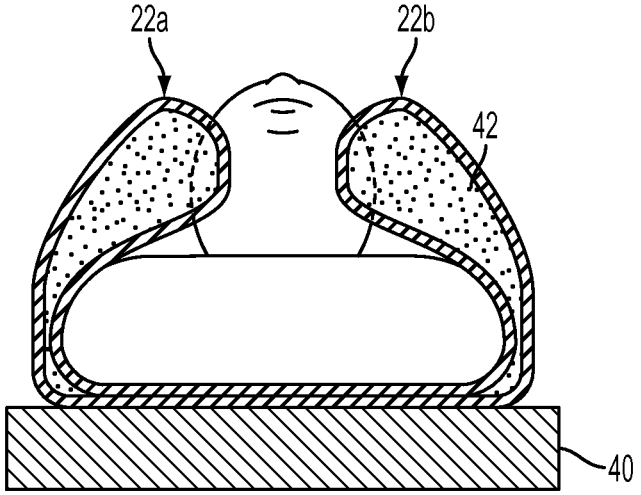
FIG. 5 is a sectional view taken along line 5-5 in FIG. 4.

FIG. 5 is a transverse sectional view of an exemplary positioning system, also in the evacuated condition, taken across the patient's shoulders and upper chest. The positioning system envelopes the patient's upper arms and a portion of the patient's upper chest while providing malleable, comfortable underlying support for the patient's posterior. The positioning system readily conforms to the patient's anatomy.

FIG. 6 is a side elevation view showing an evacuated positioner, operating table 40 and supine patient in a Reverse Trendelenburg position, with the patient's head elevated above the feet. The patient's lower legs typically are secured to the table by one or more straps. The shell, which conforms closely to the patient's anatomy, cooperates with the straps to comfortably immobilize the patient and resist the force of gravity urging the patient to slide downwardly feet first. A foot board optionally may be placed adjacent the patient's feet. The positioning system partially envelops the patient and creates a friction contact with the patient that must be overcome before the patient may slide relative to the positioner and operating table (which are effectively locked together by the straps 38*a*, 38*b*, 38*c*). The conformity of the shell to the contours of the patient's body helps keep the patient from sliding. The wrist supporting portions 30*a*, 30*b*, when folded up, support the patient's hands and wrists and also help create a narrow channel in the area of the patient's hips, which is typically smaller than the width of the patient's shoulders, thereby resisting any tendency of the patient to slide down the inclined plane formed by the operating table.

FIG. 7 is a side elevation view showing an evacuated positioner, operating table 40 and supine patient in a Steep Trendelenburg position, with the patient's feet elevated above her head, and also in a Lateral Oblique position, with the patient tilted laterally to one side. FIG. 7 also depicts the patient with her legs slightly bent and feet spaced apart for certain types of gynecological, laparoscopic, abdominal and urological procedures. It will be apparent that with the patient so positioned the tendency of gravity is to cause the patient to slide downwardly head first on the table and toward one side of the table.

In such tilted positions, the positioning system can conform to posterior and lateral portions of the patient to physically prevent the patient from sliding off the table. Embodiments of positioning systems can conform to the patient's pelvis and sacrum regions, waist, scapula and rib cage regions, shoulders, arms, neck, and/or head regions. The positioner embodiment shown in FIG. 7 can envelop the patient's shoulders, neck, and portions of the patient's arms and chest, creating a narrow channel around the patient's neck and shoulders to resist the tendency of the patient to slide either laterally or head first on the tilted operating table. The system shown in FIG. 7 provides substantial bulk and mass in the area of the patient's shoulders to help hold the patient in place. The system's conformity to the patient's anatomy (hips, lower back, waist, spine, shoulder blades, etc.) contributes to hold the patient in place.

In using the patient positioning system, the shell 12 is centered on the operating table 40, with the pillow 46 toward the head of the operating table, and securely fastened to the table using the fastening straps 38*a*, 38*b*, 38*c*. The straps may be secured to the side rails of the operating table. The shell is then smoothed out so that the internal beads 42 inside are evenly distributed. The disposable waterproof slipcover 54 is then placed over the shell 12 and tucked underneath.

The patient is then placed in the supine position on the positioner with the neck and head resting on the pillow 46. In the case of smaller or shorter patients, the pillow can be folded forward before the patient is placed in position. The inflation bulb 50 is then used to inflate the pillow as much as necessary to support and position the patient's head/neck, typically in a neutral position for most surgeries.

The lateral sides of the shell are then folded upwardly to engage the sides, shoulders and upper arms, forearms and wrists of the patient. The lateral and superior sides are snugly packed against the patient to accommodate the natural contours thereof and provide a generally U-shaped cradle for the patient. The top of the shell conforms to the patient's posterior. While holding the patient and shell in the desired position, air is evacuated from the interior of the shell 12. Specifically, the female portion of the evacuation valve 44 is attached to the male portion and a vacuum source is connected to the end of the female portion to evacuate air from the interior of the shell. Evacuation is continued until the shell is firm to provide contoured support for the patient. When the desired level of support is achieved, the female portion is detached from the male portion and the vacuum source is detached from the female portion. The shell retains its conforming shape. It will be appreciated that many types of known valve/hose constructions can be used to create and release the vacuum.

Once the patient is secured, the operating table 40 may be inclined to place the patient in the Steep Trendelenburg, Reverse Trendelenburg, Oblique Lateral or other inclined position for surgery. The positioning system can use different techniques to immobilize the patient in a comfortable manner while avoiding the application of significant local pressure to any specific region. The system can spread the cradling/supporting force over a relatively wide surface area of the patient's anatomy and yet provide easy access to a large surface area of the patient's anatomy, including the patient's forearms and lower lateral abdomen. Significantly, the system retains the patient in place by engaging a wide surface area of the patient in a way that eliminates pressure points. The shell's low profile in the vicinity of the patient's forearms also allows surgical instruments to swing lower along the side of the patient and allows the tips of medical instruments in the abdomen to reach the inner aspect of the anterior abdominal wall with less interference from the side restraints of conventional systems. Yet, the positioning system maintains contact with a sizable surface area of the patient's anatomy, including the patient's shoulders, upper arms, forearms, hands, hips and thighs. Such surface contact provides a friction surface and contour fit to resist the tendency of the patient to slip or slide longitudinally relative to the positioner.

The positioner's overall design also provides protuberances or abutments that serve as longitudinal obstructions for portions of the patient's anatomy. These obstructions resist the gravity-influenced tendency of the patient to slide or slip on the inclined operating table. For example, as shown in FIG. 7, the shoulder edge portions of the shell provide a longitudinal and lateral barrier for the shoulders of a patient subject to a gravitational force urging the patient to slide head first or laterally off the operating table. The wrist supporting portions restrain the patient's hands and arms from moving laterally relative to the operating table. As shown in FIG. 6, the wrist supporting portions/projections, when folded up, provide a longitudinal and lateral obstruction for the arms of a patient subject to a gravitational force urging the patient to slide feet first or laterally off the operating table. In this case, the positioner also cooperates with leg straps 56, which typically are used to secure the patient's lower legs to the operating table.

The shell also is designed to create narrow channels to resist sliding movement of the patient relative to the shell and the operating table. More specifically, as shown best in FIGS. 4 and 7, the shell defines a relatively narrow channel at the end where the patient's head is placed. The patient's shoulders, chest, and hips have a width dimension that exceeds the width of the head/neck channel associated with the pillow 46. Thus, when the patient is inclined head first, the narrow channel defined at the head end of the shell prevents the wider portions of the patient's anatomy from sliding longitudinally through the channel. The channel effect and shoulder wrap secures the patient even in the steepest Trendelenburg position. In addition, the wrist supporting portions 30*a*, 30*b* also define a narrowing channel in the vicinity of the patient's hands and upper thighs. For a patient to slide feet first on the operating table relative to the positioner, the patient's hips and shoulders, which are wider than the wrist channel, would have to slide through the narrow channel.

Figure 10:
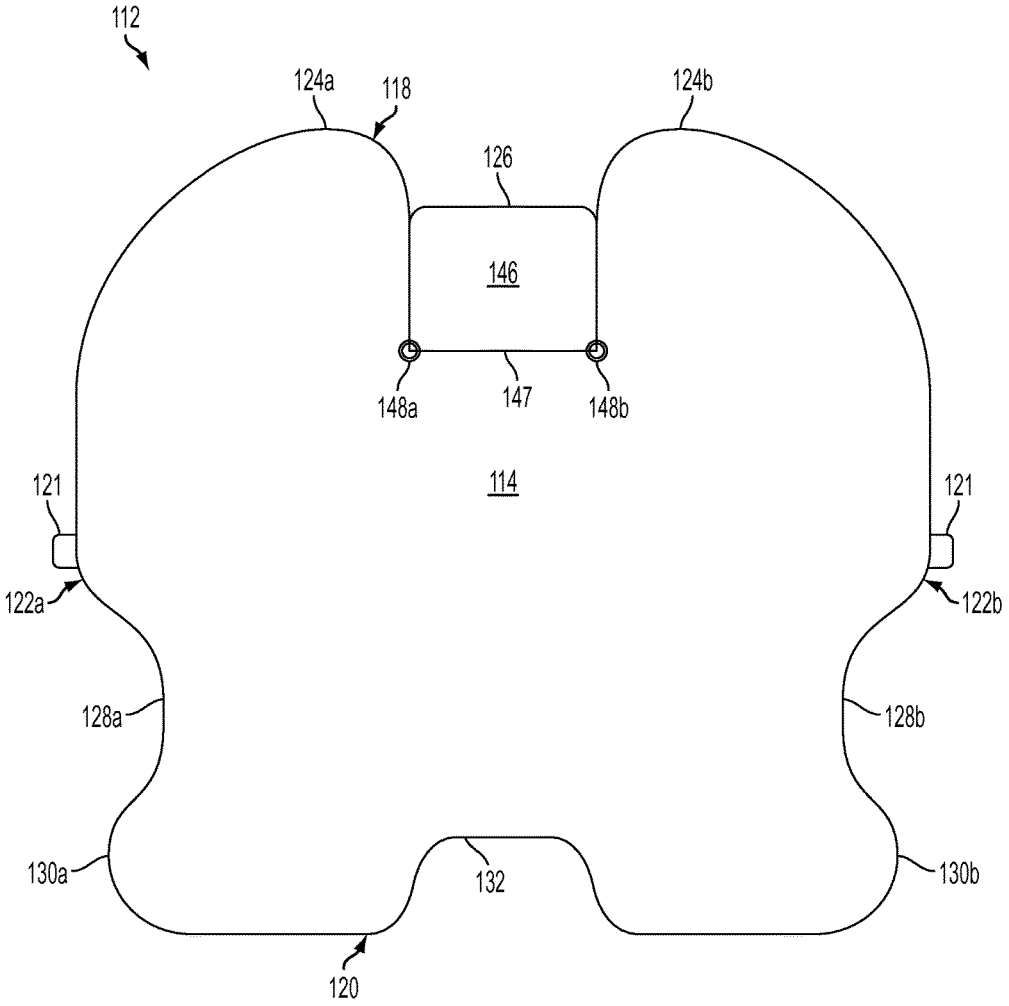
FIG. 10 is a top plan view of another exemplary embodiment of a patient positioning system.
Figure 11:
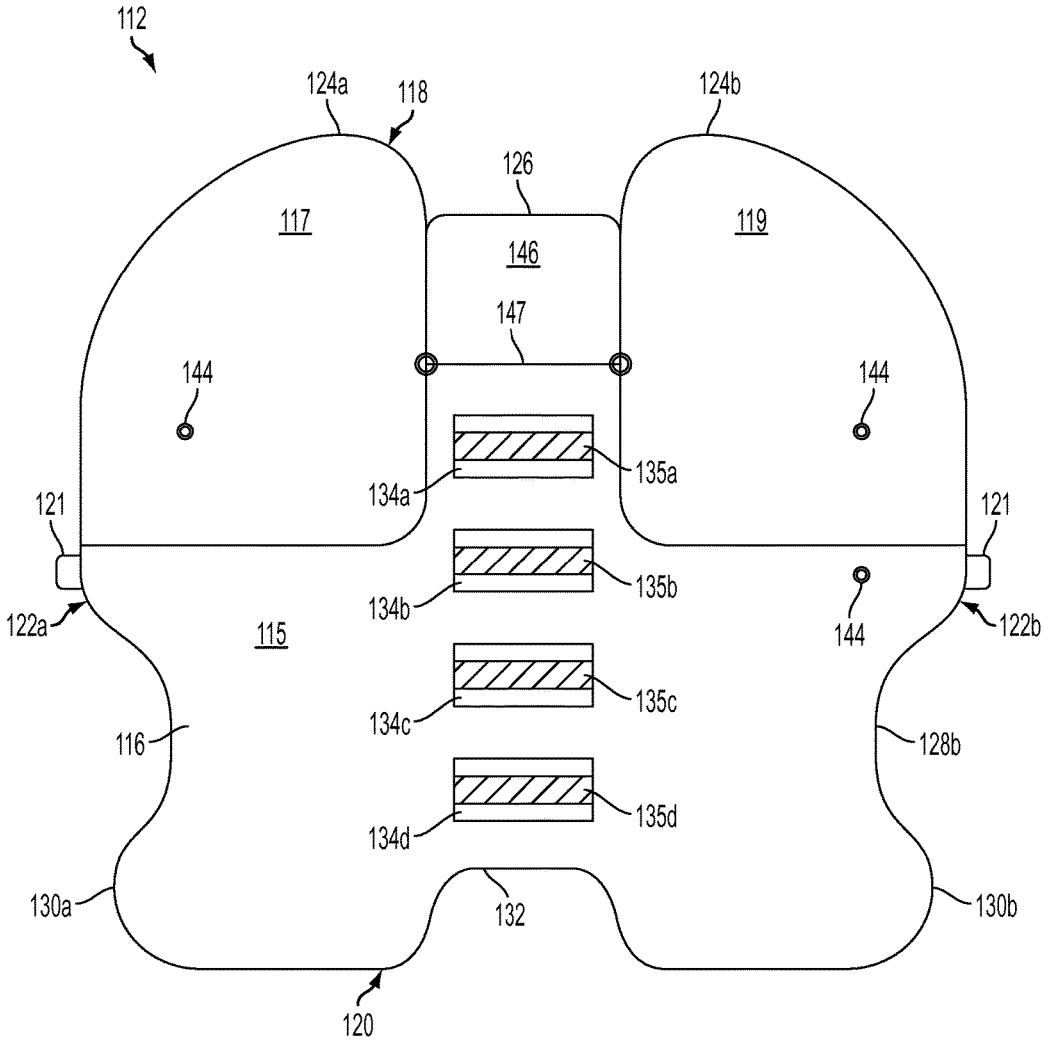
FIG. 11 is a bottom plan view of the embodiment of FIG. 10.

FIGS. 10 and 11 illustrate another embodiment of a patient positioning system that has multiple chambers. For convenience, elements that are structurally and/or functionally similar to those described above in other embodiments are designed with like reference numbers. Thus, for example, patient positioning system 112 comprises top and bottom opposing walls 114, 116 that are generally as described above with respect to other embodiments. Top and bottom walls 114, 116 are joined together at their upper, lower and lateral edges 118, 120, 122 for strength and airtightness. As will be understood by the following description, many of the features of the multi-chambered positioning devices described below are common and/or similar to those of the single-chambered positioning devices described above. Moreover, as will be understood by one of ordinary skill in the art, many features of these devices can be used interchangeably between the multi-chambered and single-chambered devices.

Patient positioning system 112 includes multiple chambers filled with beads 42 to further facilitate positioning and securing the patient using the positioning system. As shown in FIG. 11, which is a bottom view of patient positioning system 112, a plurality of chambers are provided in different areas of patient positioning system 112.

Figure 13:
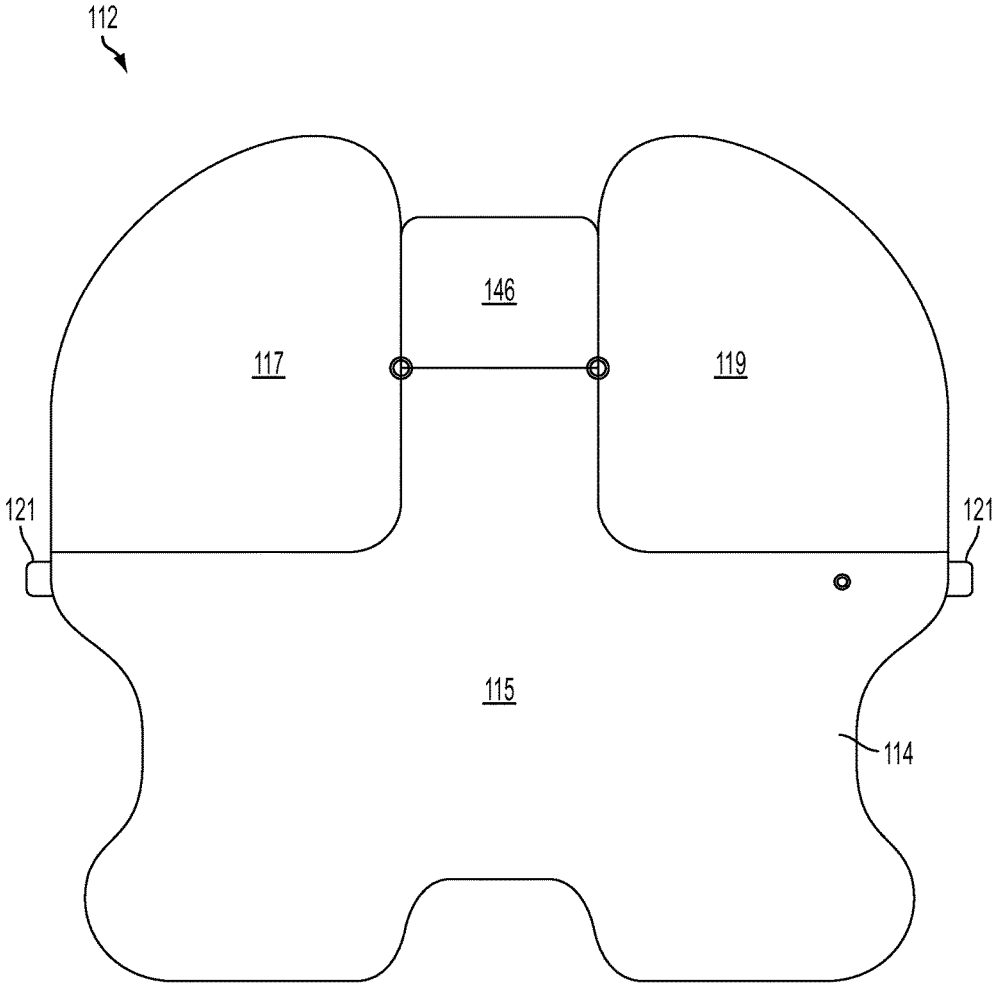
FIG. 13 is a top plan view of an embodiment of a patient positioning system.

Such chambers can be formed in a variety of manners. For example, in the embodiment shown in FIGS. 10 and 11, the plurality of chambers are formed by sealing portions of bottom walls 116 to top wall 114 (e.g., by heat sealing, radio frequency welding, etc.). By forming the various chambers in this manner, the chambers may only visible from the bottom of the patient positioning system 112. In other embodiments, however, the various chambers can be formed so that they are visible from both the top and bottom sides of the positioning system 112. For example, FIG. 13 illustrates an embodiment where the different chambers 115, 117, 119 are formed by sealing top wall 114 and bottom wall 116 so that the chambers are visible from the top side of the positioning system 112.

As shown in FIG. 11, a first main chamber 115 is provided in a central and lower area of the patient positioning system 112. In addition to main chamber 115, secondary chambers 117, 119 are preferably positioned at locations that allow for the creation of greater fixation forces between adjacent chambers to further restrict the movement of the patient relative to the positioning system 112.

By forming a plurality of adjacent chambers of beads 42, patient positioning system 112 can be formed with greater rigidity. As described above, in single chamber systems, the beads form a sold mass when air is removed from the chamber. As the solid mass forms, the beads conform to the patient to immobilize the patient in a desired position. In contrast, by forming multiple solid masses by separately evacuating adjacent chambers, not only does each of the solid masses conform to the patient to immobilize the patient in the desired position, but adjacent solid masses also interlock with one another to increase the rigidity of the system.

For example, by evacuating main chamber 115 first, main chamber 115 forms a solid mass that at least partially conforms to the patient. When the solid mass is formed, edges and surfaces of main chamber 115 form irregular surfaces (e.g., bends, folds, crinkles). As air is evacuated from secondary chambers 117, 119, each of those chambers also forms a solid mass that at least partially conforms to the patient. In addition, as each of those solid masses is formed, edges and surfaces of secondary chambers 117, 119 also form irregular surfaces (e.g., bends, folds, crinkles).

As seen in FIG. 11, main chamber 115 has various edges and surfaces that are adjacent to the edges and surfaces of at least a portion of one of secondary chambers 117, 119. After main chamber 115 and secondary chambers 117, 119 are evacuated, those adjacent edges and surfaces of main chamber 115 and secondary chambers 117, 119 are in contact with one another. Because of the irregularities of the surfaces of each of the evacuated chambers, the surfaces of secondary chambers 117, 119 at least partially interlock and/or form a frictional fit with the surface of main chamber 115. Such contact between the adjacent surfaces further increases the rigidity of the positioning system 112 by increasing friction between the adjacent surfaces, thereby restricting relative movement of adjacent chambers. In this manner, the patient positioning system can be used to further immobilize the patient in anticipation of a surgical procedure.

Secondary chambers can be positioned on positioning system 112 where greater rigidity and strength can be particularly useful, such as at a portion on positioning system 112 where the most pressure is exerted by the patient. For example, when a patient is in the Trendelenburg position (FIG. 7), this can be at an upper portion (e.g., shoulder region) of the positioning system 112, where a large portion of the patient's weight is directed.

Figure 12A:
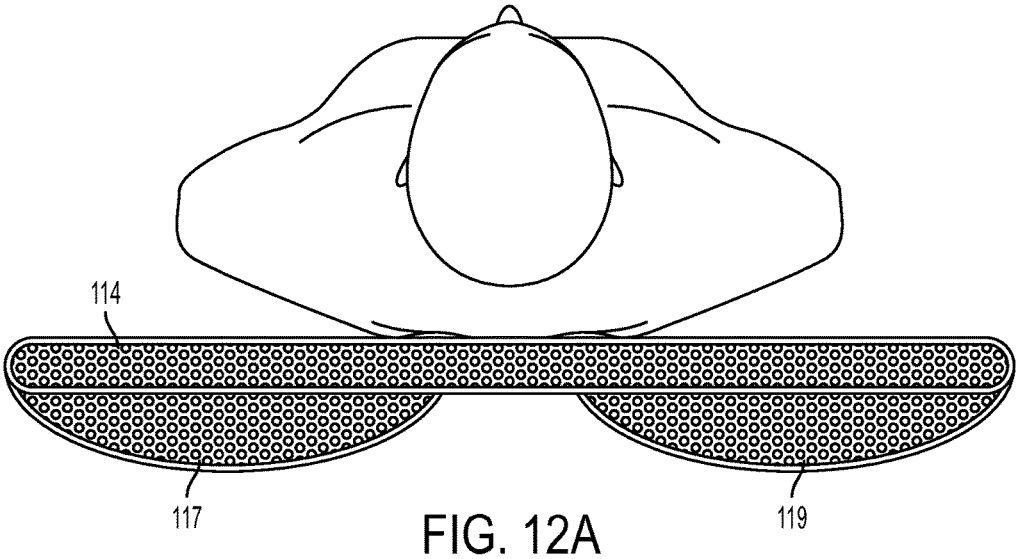
FIG. 12A is a partial cross-sectional end view of a patient positioning system.
Figure 12B:
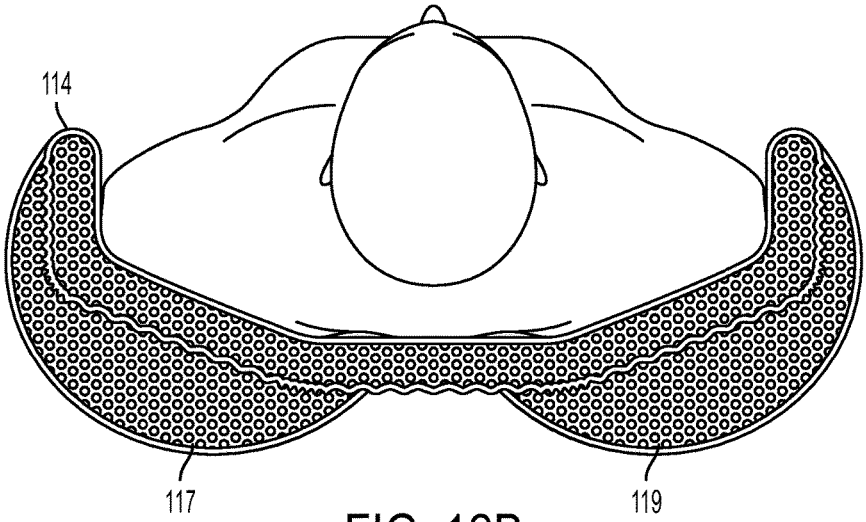
FIG. 12B is a partial cross-sectional end view of the patient positioning system of FIG. 12A, shown with chambers in an evacuated state.

As shown in FIG. 11, secondary chambers 117, 119 can be provided adjacent the upper portions of main chamber 115. FIGS. 12A and 12B illustrate end views of main chamber 115 and secondary chambers 117, 119. FIGS. 12A and 12B are partial cross-sectional views that show chambers shown in cross-section for clarity. FIG. 12A illustrates the chambers in an unevacuated state, while FIG. 12B illustrates the chambers in an evacuated state. As shown in FIG. 12B, when the adjacent chambers are evacuated, the irregularities of the surfaces of each of secondary chambers 117, 119 at least partially interlock and/or form a frictional fit with the surface of main chamber 115. As seen in FIG. 12B, this contact increases the rigidity of the positioning system 112 and restricting relative movement of adjacent chambers longitudinally (i.e., along the length of the patient) as well as laterally (i.e., towards the sides of the patient). Thus, the patient positioning system can further immobilize the patient by providing longitudinal and lateral support by the layered configuration shown in FIGS. 12A and 12.

Thus, if the patient is in a Trendelenburg position, with his or her feet above the head, the downward force exerted by the patient can be at least partially countered by the frictional forces between adjacent edges and surfaces of the main chamber 115 and secondary chambers 117, 119. As each of the chambers 115, 117, 119 conform to the patient, surfaces of the chambers contact and engage with surfaces of at least one adjacent chamber to restrict relative movement between adjacent chambers.

Although the embodiment of FIGS. 12A and 12B illustrates secondary chambers 117, 119 on top of main chamber 115, it should be understood that secondary chambers 117, 119 could be positioned below main chamber 115. In both embodiments, however, a surface of the secondary chambers 117, 119 can engage a surface of main chamber 115 to restrict relative movement between the contacting (i.e., frictionally engaged) surfaces of the chambers.

Multi-chambered positioning systems can be particularly useful for use with bariatric patients. Bariatric patients are those patients that exceed the physical size, shape, width, and/or weight of an average patient. It is not uncommon for bariatric patients to weigh in excess of 300 pounds and, in some cases, over 400 pounds. Due to the increased forces exerted by a bariatric patient on the support system, the additional rigidity and support provided by the friction forces between adjacent chambers can be particularly helpful to immobilize and position the patient in the manners described above.

In bariatric applications, the positioning system's preferred width at its widest point can be significantly larger than in other applications. Thus for example, instead of about 42 inches, the width of the positioning system can be about 54 inches which exceeds the shoulder width of most bariatric patients. The positioning system's preferred length can also be longer, with its longest point about 51 inches. Thus, when the bariatric patient is placed in the supine position on the positioning system 112, the lateral edges 122 can be folded up along the patient's neck, shoulders, arms, hips and upper thighs and packed snuggly against the bariatric patient's body to accommodate the natural contours thereof.

Referring again to FIG. 10, the upper edge 118 includes two opposed shoulder edge portions 124*a*, 124*b*, and a pillow edge portion 126 located therebetween. As shown in FIG. 11, opposing shoulder edge portions 124*a* and 124*b* are formed by respective secondary chambers 117, 119. As in other embodiments, adjacent to the pillow edge portion 126, the shoulder edge portions 124*a*, 124*b* can extend upward and away from pillow edge portion 126 a distance greater than in other embodiments. For example, in some embodiments, the shoulder edge portions 124*a*, 124*b* can extend at least 4 inches, and preferably 5 inches or more, from the pillow edge portion 126.

As in other embodiments, lateral edges 122*a*, 122*b* each define opposed cut-out portions 128*a*, 128*b*, and opposed projecting wrist supporting portions 130*a*, 130*b*. In the example, shown in FIG. 11, secondary chambers do not extend into cut-out portions 128*a*, 128*b*; however, it should be understood that different shapes and configuration of secondary chambers are possible.

As shown in FIG. 11, a plurality of strap patches 134*a*, 134*b*, 134*c*, and 134*d* can be secured by any known manner, including, for example, heat sealing, radio frequency welding or otherwise to the bottom wall 116. As in other embodiments, the patches preferably are centered and spaced apart along the positioning system's longitudinal centerline/axis. Fastener straps such as those shown in FIGS. 7 and 8 can be used to secure the positioning system 112 to an operating table 40 (e.g., FIG. 4) on which the positioning system and patient are supported. Straps can be secured to a respective fastener portion 135*a*, 135*b*, 135*c*, and 135*d* of the strap patches 134. The straps, strap patches and/or the fastener portions can comprise ballistic nylon or other strong, flexible material. In some embodiments, strap patches 134 can comprise loop portions through which straps can be positioned to secure the positioning system to the table.

It will be appreciated that once the straps are secured to the operating table, the fixed attachment of the straps to the strap patches 134*a*, 134*b*, 134*c* (and effectively to the positioning system 112 as well), keep the positioning system from sliding laterally or longitudinally on the operating table as, for example, when the table is tilted laterally while the patient in the Trendelenburg and other positions.

Additional strap and/or fastening systems can be used to further secure the patient and/or the positioning system to the table. For example, as shown in FIGS. 10 and 11, strap-receiving members 121 can be positioned at the lateral edges 122*a*, 122*b* of the positioning system 112. Strap-receiving members 121 can comprise loops or other such devices that are capable of receiving and securing a strap at the lateral edges 122*a*, 122*b*. Strap-receiving members 121 can be secured to the lateral edges 122*a*, 122*b* in any known manner, such as the heat sealing, radio frequency welding, stitching, etc. Once the positioning system 112 is evacuated so that it conforms to the patient, straps can be passed through the strap-receiving members (e.g., loops), around the patient, and to at least a portion of the operating table to further secure the patient and positioning system 112 to the operating table. Such straps can be particularly helpful when the operating table is tilted laterally as such straps can further restrict lateral movement of positioning system 112 relative to the operating table.

The strap-receiving members 121 shown in FIGS. 10 and 11 are shown positioned at lateral edges of a main chamber; however, it should be understood that such strap-receiving members 121 can be positioned at other locations on the positioning system 112, including for example, at other points along the lateral edge of the main chamber and at points along other surfaces on the main chamber (e.g., on the top and/or bottom walls). Such strap-receiving members can also be positioned on the secondary chambers 117, 119 and/or adjacent those chambers if desired.

Positioning system 112 preferably is configured to wrap around and overlie at least a portion of the patient's shoulders and upper chest, as described in other embodiments and as shown, for example, in FIG. 4. The straps that extend from strap-receiving members 121 and around the patient can also reduce the width of the positioning system 112 in its evacuated configuration. Thus, for example, if the positioning system 112 has portions that "wing" or extend laterally over the edges of the operating table, the straps can pull those portions of the positioning system 112 inward (i.e., towards the patient), thereby eliminating or reducing the amount that the positioning system 112 extends off the operating table. This can be particular useful when using a larger positioning system with bariatric patients because such positioning systems (and the patients themselves) can be wider than the operating table.

The straps can be secured around or coupled to any available portion of the operating table. For example, the straps can be secured to a side rail or, in other embodiments, can extend around the bottom of the table and be secured to another portion of the table or to itself.

In the exemplary embodiments that include multiple chambers described above, each of the various chambers can be evacuated independently of the evacuation of other chambers. Thus, as described above, main chamber 115 can be evacuated before secondary chambers 117, 119 are sequentially or concurrently evacuated. To permit independent evacuation, each of the chambers 115, 117, 119 can have a valve 144 that communicates with the interiors of the chambers 115, 117, 119 for evacuating air therefrom. Various possible valves are described in more detail above.

Figure 14:
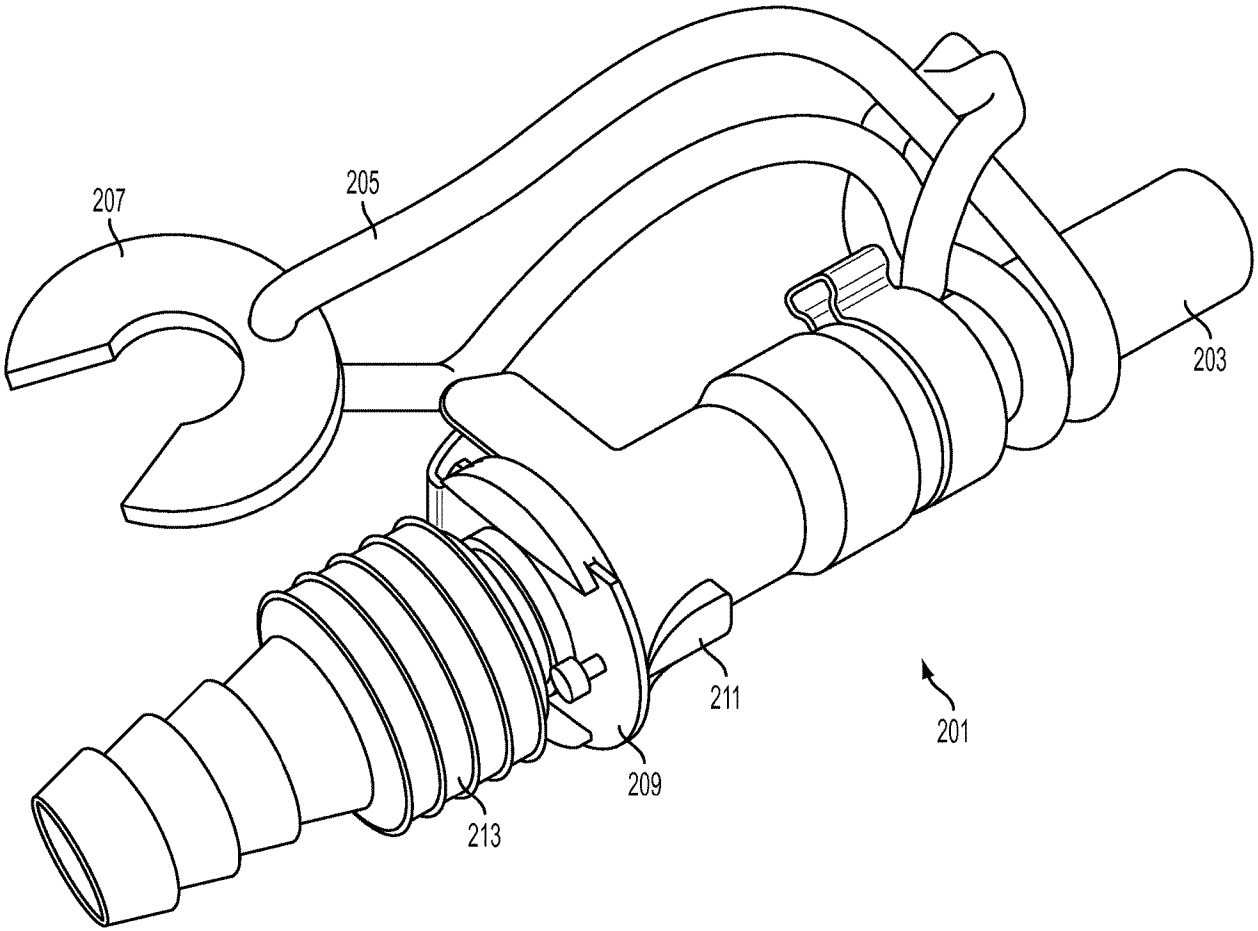
FIG. 14 is a perspective view of a locking mechanism for use with a patient positioning system, showing the mechanism in an unlocked position.
Figure 15:
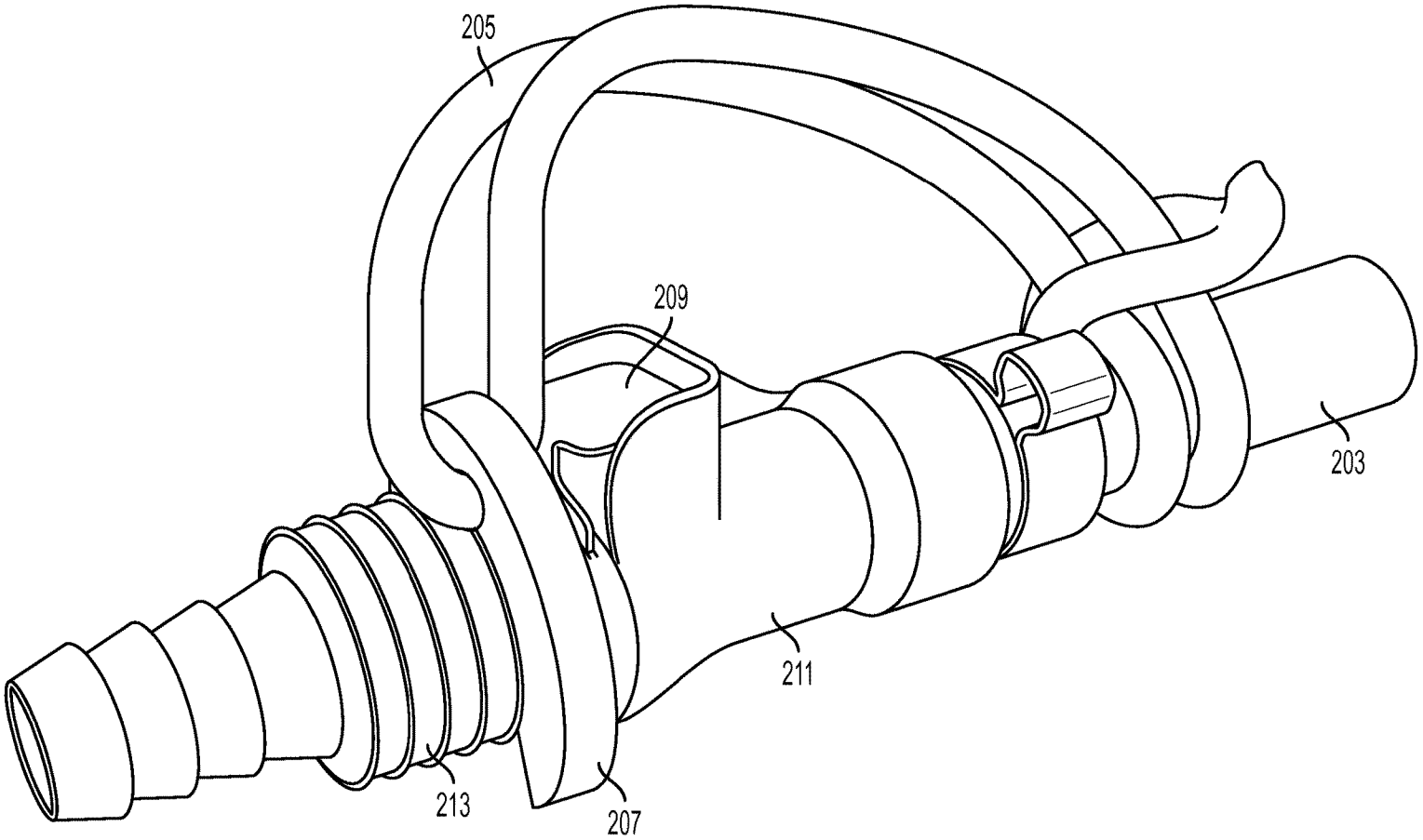
FIG. 15 is a perspective view of a locking mechanism for use with a patient positioning system, showing the mechanism in a locked position.

A valve lock can also be provided to lock the valve after evacuation to prevent an unintentional and/or accidentally release of the negative pressure applied to the positioning system during operation. FIGS. 14 and 15 illustrate an exemplary valve system 201 that can be moved between an open and a closed position to allow or restrict, respectively, the flow of air into and out of the chambers associated with that valve system 201.

FIG. 14 illustrates a valve locking system that comprises a valve stem 203, a main portion 211, and a moveable member 213 coupled to the main portion 211. Moveable member 213 can be moved inward to open the valve system 201 and allow the ingress and egress of air from the chamber associated with that valve system 201. An intermediate member 209 can be positioned between main portion 211 and moveable member 213, with the intermediate member 209 forming a slot into which a lock member 207 can be received. Lock member 207 can be formed in a C-shape so that it can be received within the slot of the intermediate member 209.

As shown in FIG. 15, when lock member 207 is inserted into the slot formed between main portion 211 and moveable member 213, moveable member 213 cannot be moved inward to the open position. Thus, lock member 207 can secure the valve system 201 in a closed position and the chance of valve system 201 being accidentally opened during a surgical procedure (or at any other undesired time) can be significantly reduced.

At least one port can be provided in one or more of the top and bottom walls 114, 116 to allow for the addition of beads to the positioning system 112. Because of the negative pressures applied to the beads, over time, the beads can deteriorate and lose some functionality. Accordingly, the port allows access to the internal chamber(s) of the system so that additional beads can be added to system. Of course, the port can also allow for the removal or exchange of beads within the positioning system. The port can comprise an opening that has a cover (e.g., a round cap) or removable member capable of allowing access to the opening. Such ports can also be schematically depicted by a square hinged member positioned along any surface of one or more chambers. Port(s) are preferably positioned on the bottom wall 116 of the positioning system so that the port(s) are not located on the side of the positioning system that contacts the patient.

Figure 17:
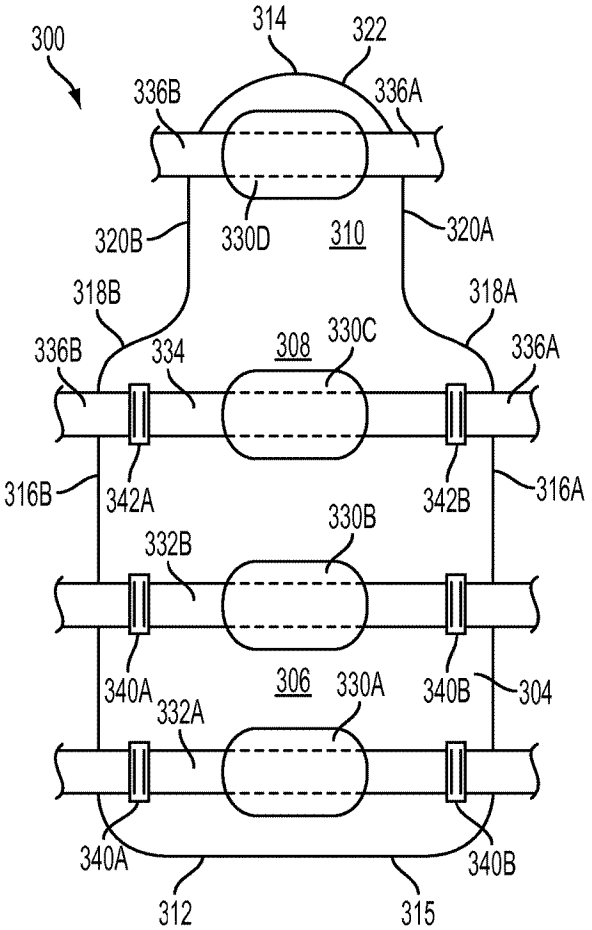
FIG. 17 shows a lower support side of the patient positioner of FIG. 16.
Figure 18:
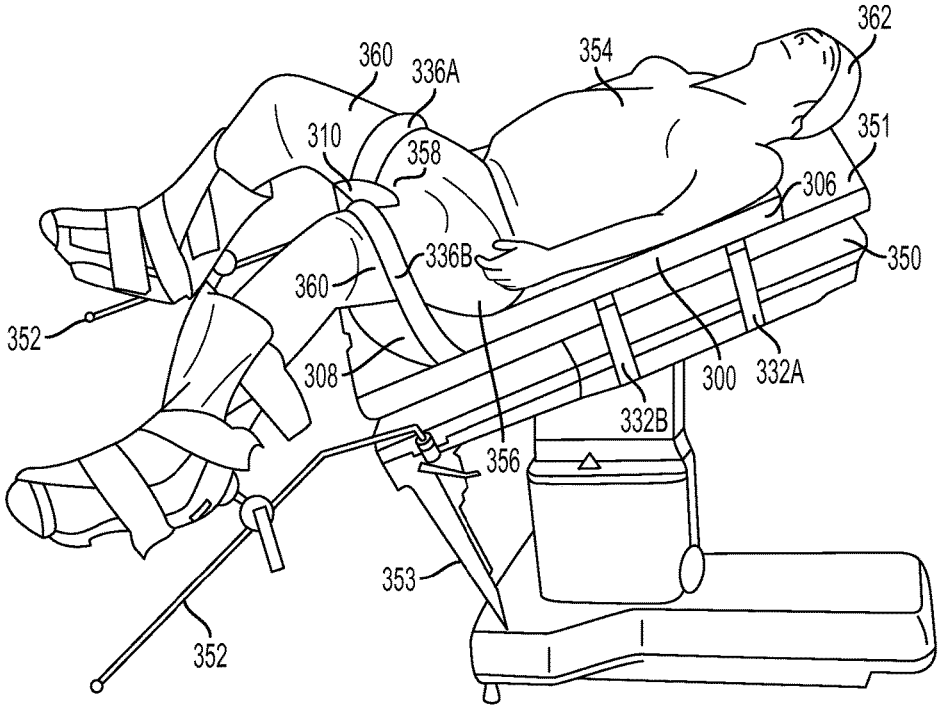
FIG. 18 shows an example of a patient supported by the patient positioner of FIG. 16 on a table in an inclined position.

FIGS. 16-21 show an exemplary patient positioner 300 for holding or supporting a patient in an inclined supine position with the patient's upper torso and head positioned higher than the patient's lower torso, such as in the Reverse Trendelenburg Position, as shown in FIG. 18. In such an inclined position, the patient can tend to slide off the support surface feet first due to gravity. The positioner 300 can be used to hold the patient in an inclined position and prevent the patient from sliding feet first relative to a tilted support surface, such as an operating table. The positioner 300 can be secured to the underlying support surface, such as with straps, and can comprise a portion that extends around the patient's tail bone region, or caudal region, and up through the patient's perineal region to provide a physical impediment that prevents the patient from sliding feet first.

The positioner 300 can have a construction and operability similar to other patient positioners described herein (e.g., the positioners 12 and 112), and comprises a flexible, evacuatable outer shell and a quantity of small beads contained within the shell. The positioner 300 comprises an upper, or patient, surface 302 (shown in FIG. 16) and a lower, or support, surface 304 (shown in FIG. 17). The lower surface 304 is configured to face toward an underlying support, such as an operating table. The upper surface 302 is configured to face toward the posterior of a patient lying in a supine position.

The positioner 300 comprises a broad torso portion 306, a tapered caudal portion 308, and a narrower perineal portion 310. The positioner 300 comprises a superior end 312 at the torso portion 306, and an inferior end 322 at the perineal portion 310. The torso portion 306 can comprise a generally rectangular shape and can comprise rounded corners. The torso portion 306 can comprise a superior end 312, a left lateral side 316A and a right lateral side 316B.

The caudal portion 308 is integrally connected to an inferior end of the torso portion 306 and can narrow or taper in width moving from the broader torso portion 306 toward the narrower perineal portion 310. The caudal portion 308 can comprise left and right lateral sides 318A, 318B that are integral with the lateral sides 316A, 316B of the torso portion 306. Each of the lateral sides 318 can comprise a first curve 370 that extends from the lateral sides 316 and curves medially, and a second curve 372 that extends from adjacent the first curve 370 and curves in the opposite direction of the first curve 370 to connect integrally with lateral sides 320 of the perineal portion 310.

The perineal portion 310 is integrally connected to an inferior end of the caudal portion 308 and comprises left and right lateral sides 320A, 320B that are integral with the lateral sides 318 of the caudal region 308. The perineal portion 310 can further comprise a rounded inferior end 322 at the inferior end of the positioner 300 that connects the left and right lateral sides 320A, 320B.

Figure 20:
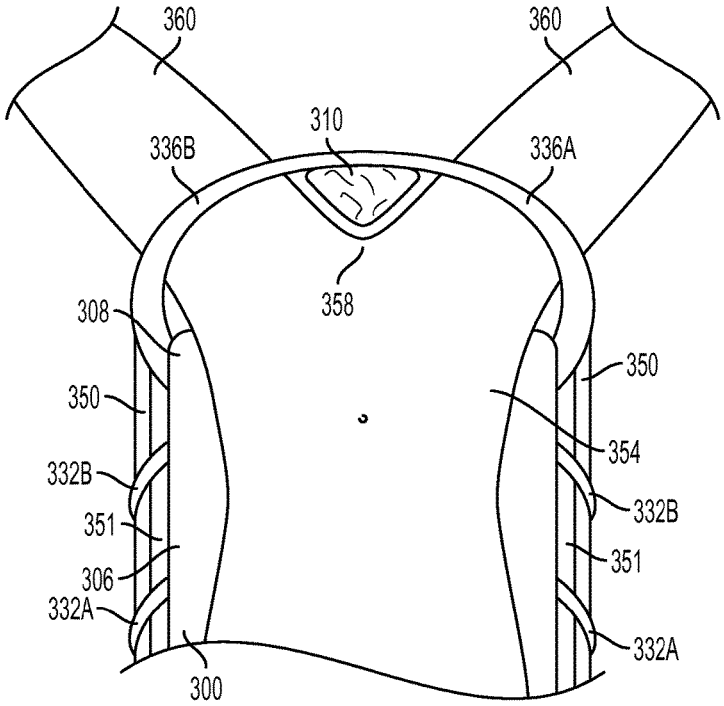
FIG. 20 is a top view of a patient being supported by the patient positioner of FIG. 16 with a perineal portion of the positioner positioned against the patient's perineal region and supported by thigh straps.
Figure 21:
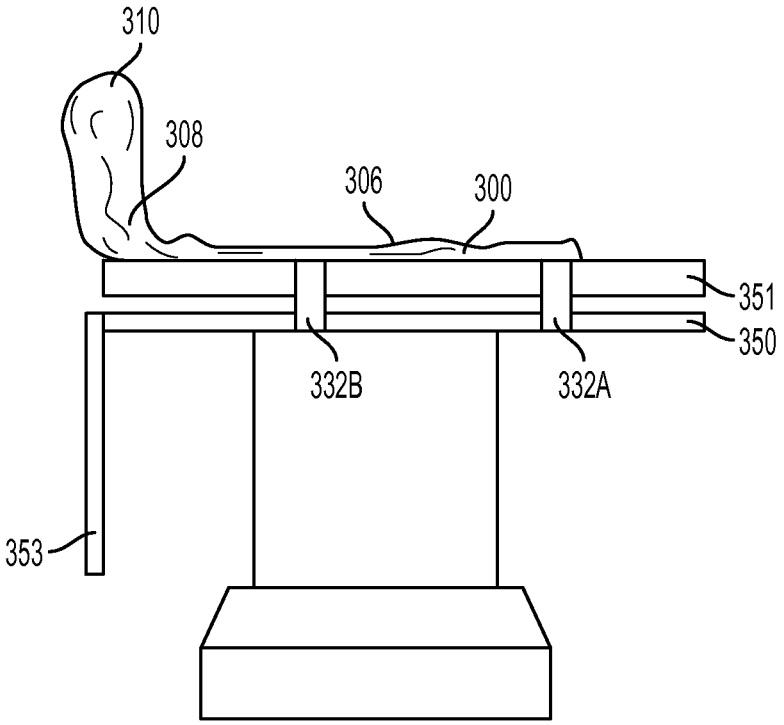
FIG. 21 is a side view of an operating table in a flat position with the patient positioner of FIG. 16 secured to the table in an evacuated configuration.

With reference to FIG. 17, the lower surface 304 of the positioner 300 can comprise a plurality of strap patches 330 attached to the lower surface 304 for coupling a plurality of straps to the positioner 300. Strap patches 330A and 330B can be attached to the torso portion 306 and can support straps 332A and 332B that are configured to strap the positioner to the underlying support, such as an operating table 350 as shown in FIG. 18. Each of the straps 332A, 332B can comprise buckles or other securing mechanisms, such as the buckles 340A and 340B shown in FIG. 17, to secure the straps around the underlying support. For example, the straps 332A, 332B can extend from the buckles 340A, loop around underneath the support structure, and connect the buckles 340B, or vice versa, to secure the positioner to the support structure. In some embodiments, only one buckle 340 is present. In some embodiments, the buckles 340 can comprise a male end portion that is inserted into a female end portion. In some embodiments, the straps can comprise length adjustment mechanism and/or tightening mechanisms to adjust the length of the straps and tighten/loosen the straps for a desirable fit with the underlying support. Other types of attachment mechanisms can also be used, such as hook and loop fasteners, belt-buckle type fasteners, etc. As shown in FIGS. 18, 20 and 21, the straps 332A, 332B can extend around both an operating table 350 and a table pad, or other layer of material, 351 between the positioner 300 and the table 350.

Figure 19:
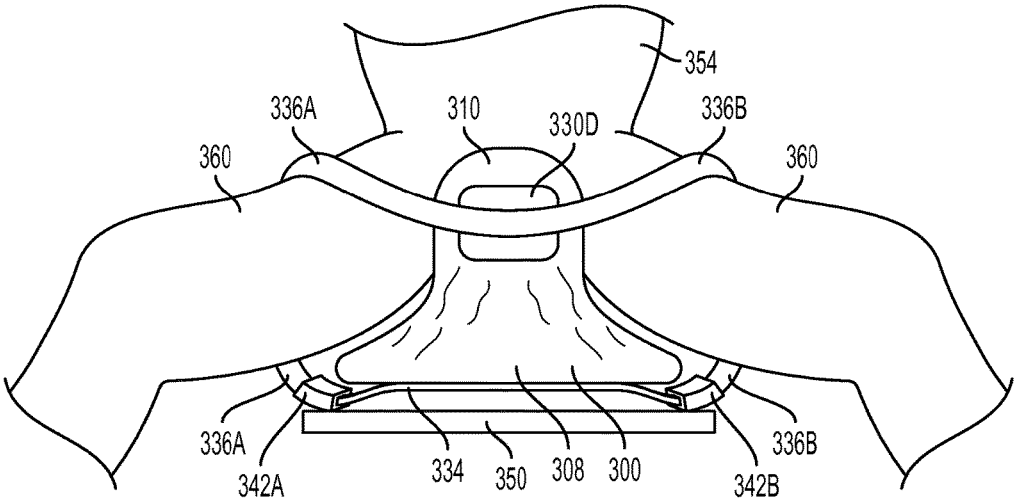
FIG. 19 shows a perineal portion of the positioner of FIG. 16 positioned against a patient's perineal region with thigh straps supporting the perineal portion.

Strap patch 330C can be attached to the caudal portion 308 and strap patch 330D can be attached to the perineal portion 310. Patches 330C and 330D can support straps 336A and 336B that are configured to loop around the patient's thighs 360 as shown in FIGS. 18-20. The right strap 336A is configured to loop around the patient's right thigh and the left strap 336B is configured to loop around the patient's left thigh. As shown in FIG. 19, the right strap 336A can comprise a buckle 342A and the left strap 336B can comprise a buckle 342B. The buckles 342 can be positioned anywhere along the straps 336, and are desirably positioned adjacent to and underneath the caudal portion 308, as shown in FIG. 19.

The straps 336A, 336B can be integrally connected across the perineal portion 310, as shown in FIG. 19. The straps 336A, 336B, when unbuckled, can extend in either direction from the perineal patch 330D and a separate caudal strap portion 334 can be attached to the caudal patch 330C between the buckles 342. When a patient is positioned on the positioner 300 with the perineal portion 310 extending upward through the patient's perineal region 358, as shown in FIGS. 18-20, the straps 336A, 336B can be looped around the lateral sides of the thighs 360 and coupled to opposite ends of the caudal strap portion 334 adjacent the caudal portion 308 via the two buckles 342. In some embodiments, the buckles 342 can each comprise a male end portion that is inserted into a female end portion, such as with the male end portion attached to the straps 336 and the female end portion attached to the caudal strap portion 334. When buckled together, the buckles 342 can be positioned underneath the positioner 300 to keep them out of the way of the surgery and/or protect them from fluids and materials from the surgery. The straps 336 can comprise length adjustment mechanisms and/or tightening mechanisms to adjust the length of the straps and tighten/loosen the straps for a desirable fit around the patient's thighs 360. Other types of attachment mechanisms can also be used, such as hook and loop fasteners, belt-buckle type fasteners, etc. The straps 332, 334 and 336 can comprise ballistic nylon material in some embodiments to provide enhanced strength. Pads can be positioned between the thigh straps 336 and the patient's thighs to prevent chaffing or pressure sores.

As shown in FIGS. 18 and 21, the caudal portion 308 of the positioner can be positioned above the lower end of the operating table 350, such that a leg portion 353 of the operating table can be folded down to provide access for a surgeon to be between the patient's legs, such as for an upper or lower abdominal procedure. In addition, the table 350 can comprise stirrups 352 to hold the patient's legs up and apart.

As shown in FIGS. 18-20, the thigh straps 336 can help retain the perineal portion 310 of the positioner in the upright position against the patient's perineal region 358 to form a physical stop that resists the gravitational forces that tend to pull the patient feet first off the table 350 when in an inclined position. The straps 336 can supplement the intrinsic rigidity of the positioner 300 itself, which becomes significantly rigid when evacuated of air, as described above.

With the table 350 in a flat position, the positioner 300 can be strapped to the table using the table straps 332A, 332B. Prior to evacuating the air from the positioner 300, the perineal portion 310 can extend over the lower end of the table 350. After a patient is positioned on the torso portion 306 of the positioner, the patient's buttocks is brought down to adjacent the lower end of the table 350, and the patient's legs are placed in the stirrups 352, the perineal portion 310 can be folded up against the patient's perineal region 358. Subsequently, the air is evacuated from the positioner 300 making the perineal portion 310 rigidly positioned in the patient's crotch. The straps 336 extending from either side of the perineal portion 310 can then be wrapped around the patient's thighs 360 and attached to the buckles 342 at either end of the caudal strap portion 334. Alternatively, the thigh straps 336 can be buckled around the thighs before the air is evacuated from the positioner 300. The straps 336 can then be cinched or tightened sufficiently to keep the perineal portion 310 tightly secured against the patient's perineal region 358 and prevented from flexing downward under the patient's weight. The table 350 can then be inclined as shown in FIG. 18 to put the patient securely in a reverse Trendelenburg position.

Figure 16:
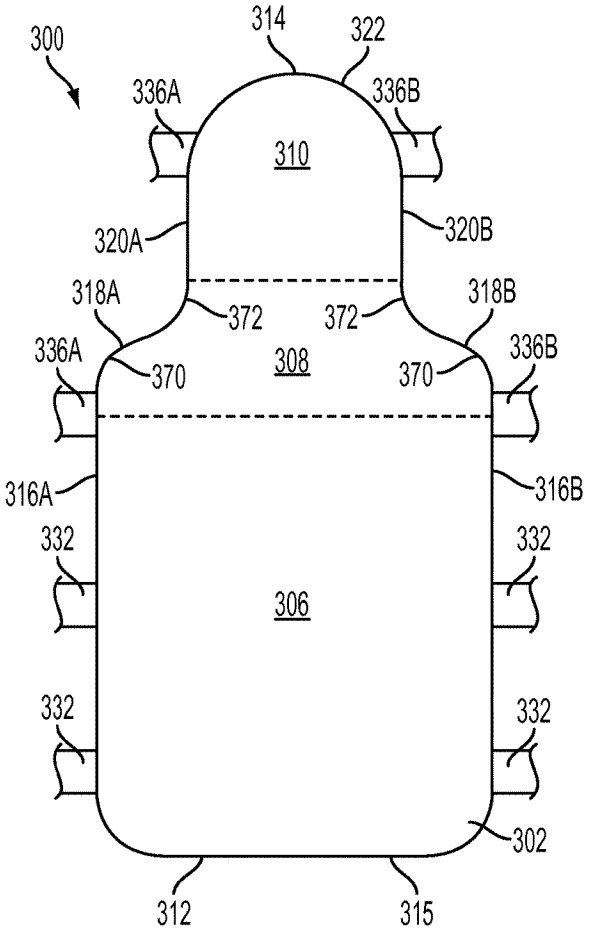
FIG. 16 shows an upper patient side of another exemplary patient positioner.

The torso portion 306 of the positioner 300 can comprise a width to fit a particular patient's body size. In some embodiments, the width of the torso portion 306 can be about 20 inches, for example. The length of the torso portion 306 can be somewhat shorter than the patient's torso such that the superior end 312 is below the patient's neck. This can provide room around the shoulder and neck region for surgical equipment. The length of the torso portion 306 can be about 24 inches in some embodiment, and can depend on the length of the patient's torso. The width of the perineal portion 310 can be sized to snuggly fit between the patient's thighs 360 against the perineal region 358, and can be about 11 inches in some embodiments. The radius of the curved inferior end 322 of the perineal portion can be about 5.5 inches. The radius of the curves 370 and 372 (FIG. 16) and the rounded corners of the torso portion can be about 2.5 inches. The overall length of the positioner 300 can be about 41 inches. The patches 330 can be about 8 inches long and about 4 inches wide. The straps 332, 334, 336 can be about 2 inches wide. All of the dimensions in this paragraph correspond to the positioner 300 being in a not evacuated positioned as shown in FIGS. 16 and 17.

Some embodiment of the positioner 300 can further comprise any one or more of the various features disclosed herein with regard to the positioners 12 and 112 shown in FIGS. 1-15.

Figure 23:
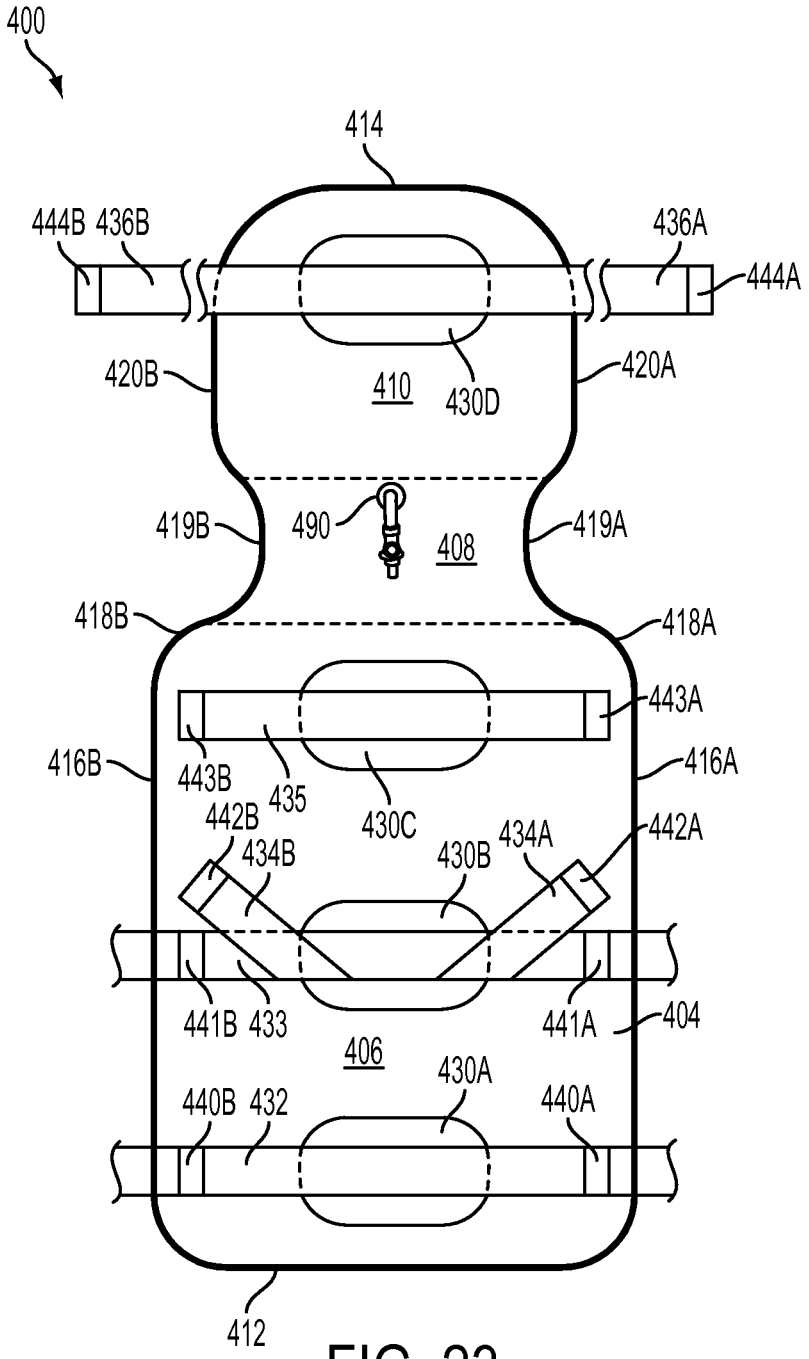
FIG. 23 shows a lower side of the patient positioner of FIG. 22.
Figure 24:
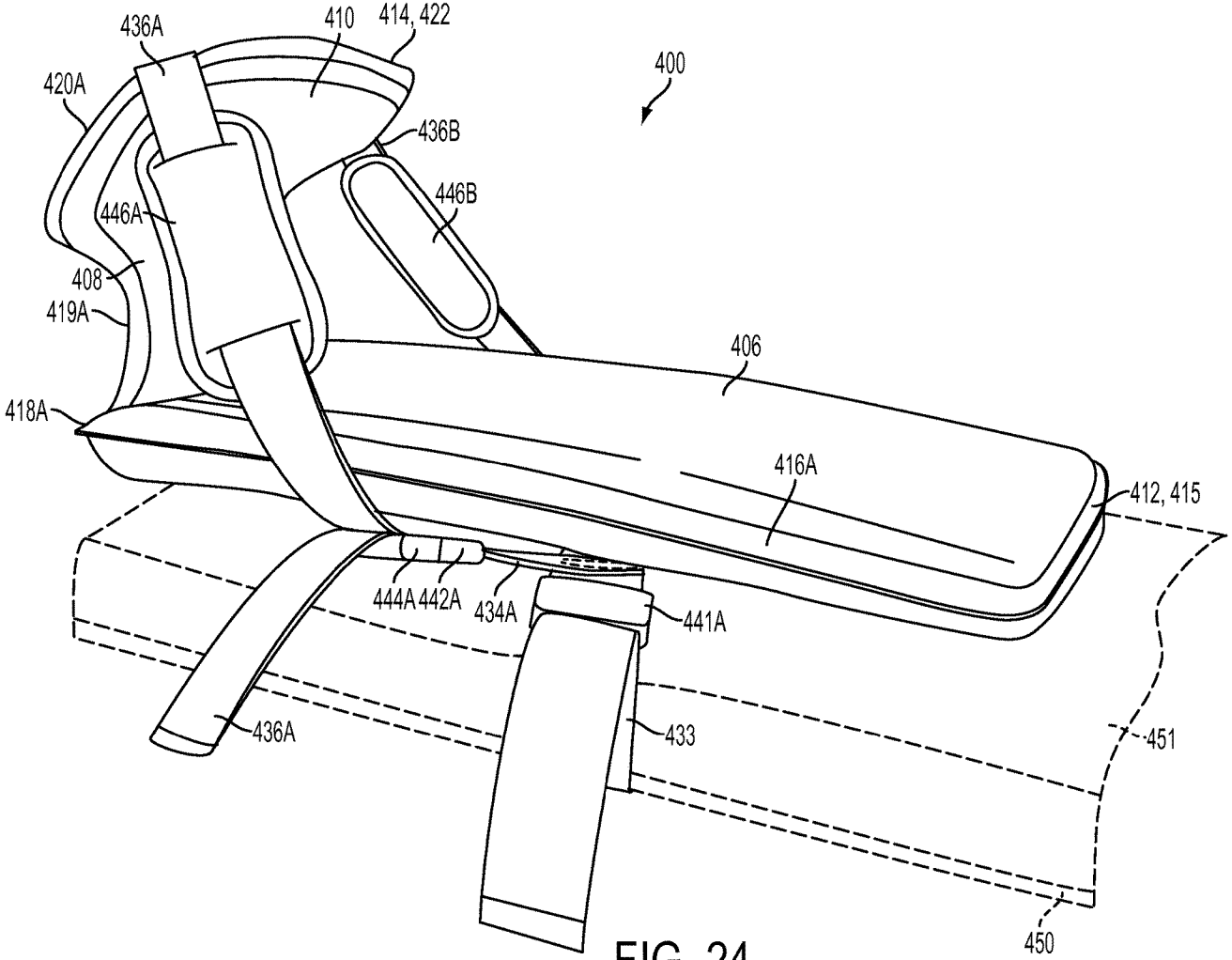
FIG. 24 is a perspective view of the patient positioner of FIG. 22 in an operative configuration without a patient.
Figure 25:
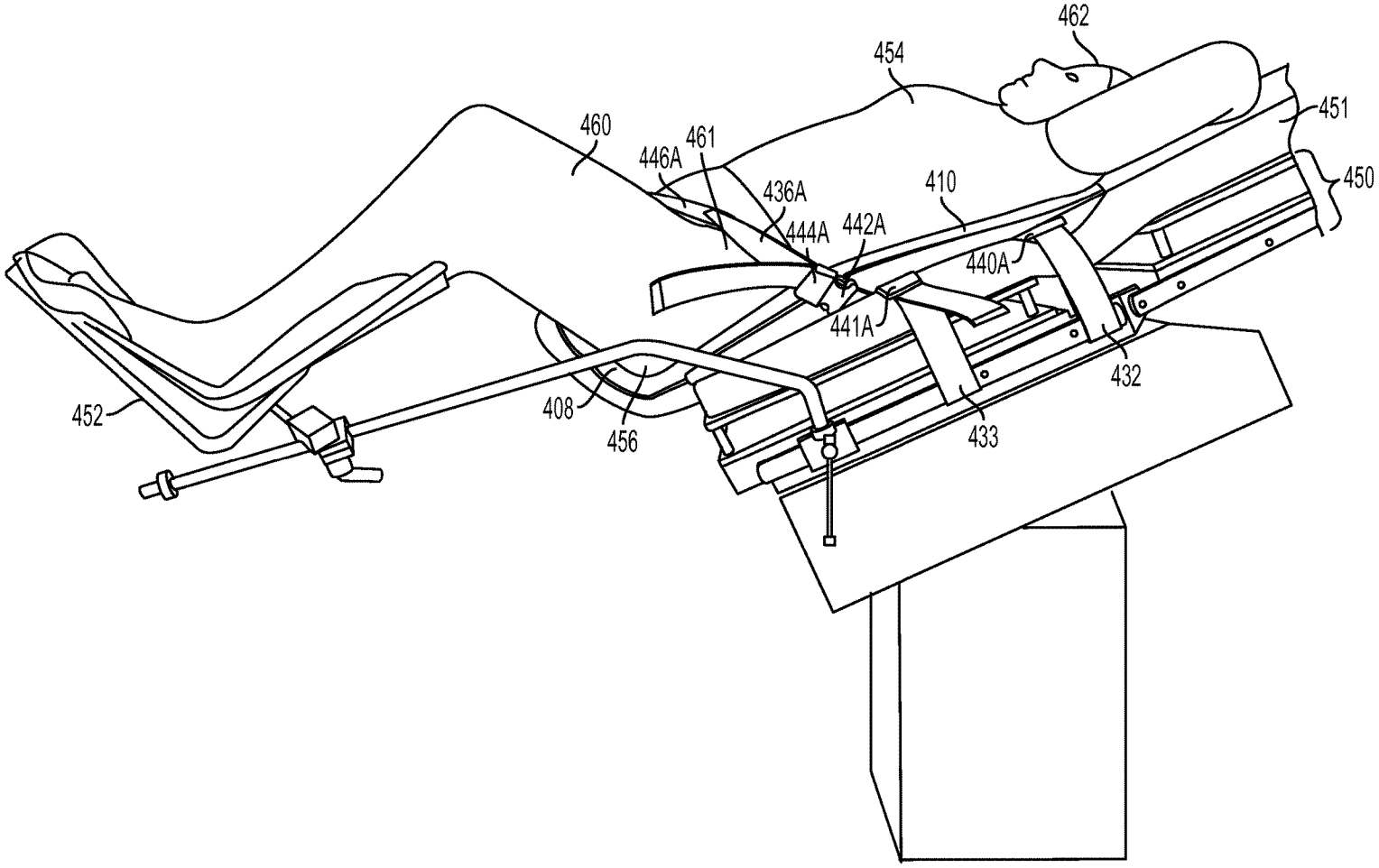
FIG. 25 shows a side view of a patient supported by the patient positioner of FIG. 22 on a table in an inclined position.

FIGS. 22-27 show another exemplary embodiment of a patient positioner 400 for holding or supporting a patient in an inclined supine position with the patient's upper torso and head positioned higher than the patient's lower torso, such as in the Reverse Trendelenburg Position, as shown in FIG. 25. Like the positioner 300, the positioner 400 can be used to hold the patient in an inclined position and prevent the patient from sliding feet first relative to a tilted support surface, such as an operating table. In an operative position (see FIGS. 24-27), the positioner 400 can be secured to the underlying support surface, such as with straps, and can extend around the patient's caudal region and up through and around the patient's perineal and/or pubic regions to provide a physical impediment that prevents the patient from sliding feet first.

The positioner 400 can have a construction and operability similar to other patient positioners described herein (e.g., the positioners 12, 112, 300), and comprises a flexible, air-evacuatable outer shell and a quantity of small beads contained within the shell. The term "beads" as used herein means any solid, independent pieces, such as balls, grains or particles, comprising any material and having any shape, including spherical and/or non-spherical shapes. The positioner 400 comprises an upper, or patient, surface 402 (shown in FIG. 22) and a lower, or support, surface 404 (shown in FIG. 23). The lower surface 404 is configured to face toward an underlying support, such as an operating table. The upper surface 402 is configured to face toward the posterior of a patient lying in a supine position.

The positioner 400 comprises a broad torso portion 406, a narrower intermediate portion 408, and a suprapubic portion 410 that is broader than the intermediate portion 408. The positioner 400 comprises a superior end 412 at the torso portion 406, and an inferior end 414 at the suprapubic portion 410. The torso portion 406 can comprise a generally rectangular shape and can comprise rounded corners. The torso portion 406 can comprise a superior end 412, a left lateral side 416A and a right lateral side 416B.

The intermediate portion 408 is integrally positioned between an inferior end of the torso portion 406 and a superior end of the suprapubic portion 410. The intermediate portion 408 can form a narrowed or necked region between torso portion 406 and the suprapubic portion 410 and can comprise left and right lateral cutouts 419A, 419B that curve inwardly between left and right corners 418A, 418B of the torso portion and left and right lateral sides 420A, 420B of the suprapubic portion.

The suprapubic portion 410 extends from an inferior end of the intermediate portion 408 and comprises left and right lateral sides 420A, 420B (which can be straight or curved) and an inferior end 414 (which can be straight or curved) at the inferior end of the positioner 400 that connects the left and right lateral sides 420A, 420B.

With reference to FIG. 23, the lower surface 404 of the positioner 400 can comprise a plurality of strap patches 430 attached to the lower surface 404 for coupling a plurality of straps to the positioner 400. Strap patches 430A, 430B and/or 430C can be attached to the torso portion 406 and strap patch 430D can be attached to the suprapubic portion 410. Patches 430A and 430B can support laterally extending straps 432 and 433 that are configured to strap the positioner to the underlying support, such as an operating table 450 as shown in FIG. 24. In some embodiments, only one of the table straps 432 or 433 is present (e.g., in FIG. 24, the strap 433 is present and the strap 432 is not present), and in other embodiments, additional table straps are present. Each of the table straps 432, 433 can comprise buckles or other securing mechanisms, such as the buckles 440A, 440B, 441A and/or 441B shown in FIG. 23, to secure the table straps to and/or around the underlying support. For example, the strap 432 can extend from the buckles 440A, loop around underneath the operating table 450, and connect the buckle 440B, or vice versa, to secure the positioner to the support structure. In some embodiments, only one of the buckles 440A or 440B is present and only one of the buckles 441A or 441B is present. In some embodiments, the buckles 440, 441 can comprise length adjustment mechanisms and/or tightening mechanisms to adjust the length of the straps 432, 433 and tighten/loosen the straps for a desirable fit with the underlying support. Other types of attachment mechanisms can also be used, such as hook and loop fasteners, belt-buckle type fasteners, etc. As shown in FIGS. 24 and 25, the straps 432 and 433 can extend around an operating table 450 and a table pad, or other layer(s) of material, 451 between the positioner 400 and the table 450.

As shown in FIG. 23, left and right strap segments 434A and 434B extend from the strap patch 430B and/or the table strap 433. In some embodiments, the segments 434A, 434B can be part of the same integral strap that crosses over the patch 430B. The strap segments 434A, 434B can extend at an angle between the lateral axis of the table strap 433 and the superior-inferior axis. For example, the strap segments 434A, 434B can each extend at about 40° from the lateral axis of the table strap 433, as shown in FIG. 23. The strap segments 434A, 434B can each comprise an attachment mechanism 442A, 442B, respectively, at its end for attaching the strap segments 434A, 434B to thigh straps 436A, 436B, respectively, as shown in FIG. 24 and discussed in more detail below.

In some embodiments, a third strap patch 430C can be attached to the torso portion 406 and a strap segment 435 can be attached to the strap patch 430C, as shown in FIG. 23. The strap segment 435 can extend laterally and comprise attachment mechanisms 443A, 443B at each lateral end. The attachment mechanisms 443A, 443B can serve as alternative connection points for the thigh straps 436A, 436B. In other embodiments, straps segments configured to attach with the thigh straps 436 can be located at other parts of the positioner, such as at the strap patch 430A or in the intermediate portion 408.

Figure 27:
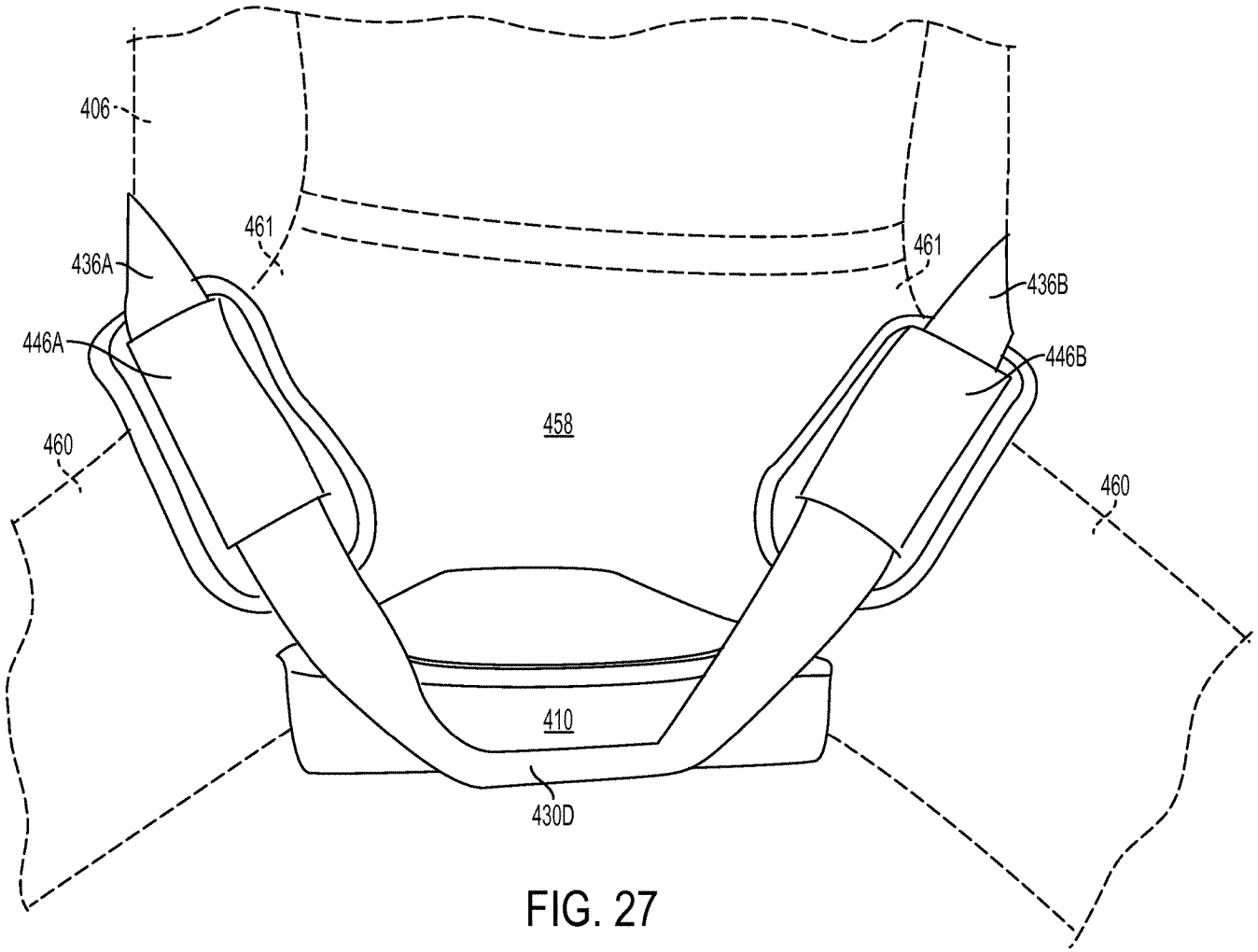
FIG. 27 is a top view of a portion of a patient being supported by the patient positioner of FIG. 22 with a suprapubic portion of the positioner positioned against the patient's perineal/pubic region and supported by thigh straps.

Strap patch 430D is attached to the suprapubic portion 410 and supports thigh straps 436A and 436B that are configured to loop around the patient's thighs 460 or hips 461, as shown in FIGS. 25 and 27. The right strap 436A is configured to loop around the patient's right thigh or hip and the left strap 436B is configured to loop around the patient's left thigh or hip. The right strap 436A can comprise an attachment mechanism 444A and the left strap 436B can comprise an attachment mechanism 444B. The attachment mechanisms 444 can be adjustable along the length of the thigh straps 436 and are configured to be attached to either the attachment mechanisms 442A, 442B of the strap segments 434A, 434B, or the attachment mechanisms 443A, 443B of the strap segment 435. In some embodiments, the attachment mechanisms 442A, 442B and 443A, 443B comprise female receivers and the attachment mechanisms 444A, 444B comprise male projections that mate with the female receivers to secure the thigh straps 436 to either the strap segments 434 or the strap segment 435. The attachment mechanisms can comprise buckles, clips, or other releasable securement devices such that the straps are securely fastened until a person actively releases the devices. The straps 436A, 436B can be integrally connected across the suprapubic portion 410, as shown in FIGS. 23 and 37.

Figure 26:
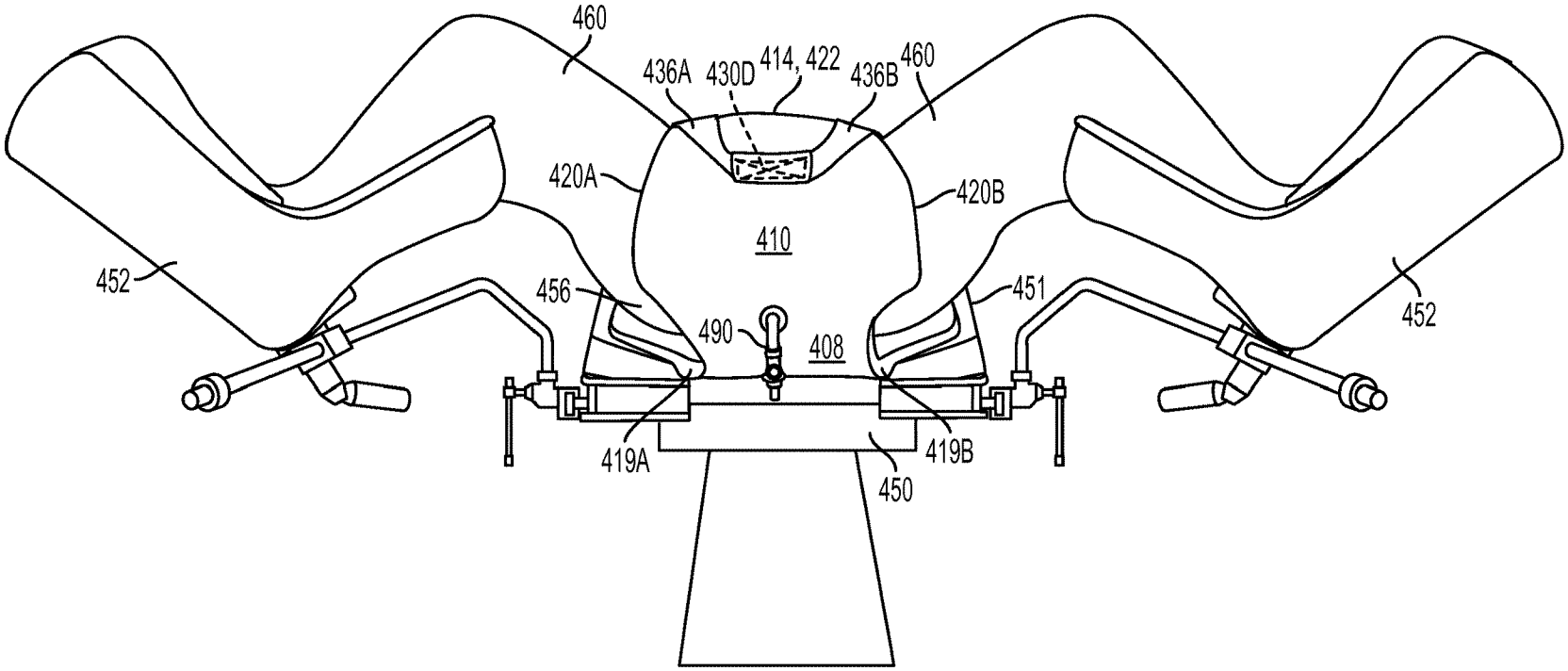
FIG. 26 shows a suprapubic portion of the positioner of FIG. 22 positioned against a patient's perineal/pubic region with the patient on a table in an inclined position.

When a patient is positioned on the positioner 400 with the suprapubic portion 410 positioned along the patient's perineal/pubic region 458, as shown in FIGS. 25-27, the straps 436A, 436B can be looped around the anterior and lateral sides of the thighs 460 or hips 461. The straps 436 can extend from the patch 430D at angle across the thighs/hips in a superior, lateral, and posterior direction. The straps can comprise ballistic nylon material in some embodiments to provide enhanced strength. Pads, such as pads 446A and 446B shown in FIG. 27, can be positioned along the thigh straps 436A, 446B to protect the patient's thighs and hips from chaffing or pressure sores.

As shown in FIGS. 25 and 26, the intermediate portion 408 of the positioner can be positioned adjacent to the inferior end of the operating table 450 when a leg portion of the operating table is folded down or removed and the patients legs are supported in stirrups 452 or in a similar position. The cutouts 419A, 419B provide relief around the patient's inner thighs, as shown in FIG. 26. The cutouts 419A, 419B help distribute the positioner's contact forces more evenly around the patient's inner thighs and reduces the amount of pressure on the patient's obturator nerves and adjacent nerves and soft tissue.

The suprapubic portion 410 of the positioner 400 extends from the intermediate portion 408 and is positioned against the patient's perineal/pubic region 458, as shown in FIG. 27. The suprapubic portion 410 has a greater width than the intermediate portion 408 and can extend laterally to also contact portions of the patient's inner and upper thighs, hips, and/or lower abdomen, thereby distributing contact forces over a greater surface area and reducing pressure concentration in any given area. When the underlying support surface is tilted, as shown in FIG. 25, the suprapubic portion 410 support a significant portion of the patient's weight and thus distributing the pressure more evenly and broadly can provide increased comfort for the patient and reduce the risk of contact sores or other injury to the patient.

The interface between the patient and the intermediate and suprapubic portions 408, 410 can vary depending on the size and position of the patient and how the patient is initially positioned on the positioner prior to evacuating the positioner. The patient-positioner interface shown in FIGS. 25-27 is only one example. In the evacuated configuration, the intermediate portion 408 can be positioned anywhere between the patients buttocks and caudal regions (as shown in the example of FIG. 26) to the patient's perineal and inner thigh regions. Desirably, the intermediate portion 408 is positioned with the lateral cutouts 419A, 419B positioned along the patient's inner thighs or buttocks regions to avoid putting pressure on the patient's obturator nerves and/or other adjacent soft tissue. Consequently, the suprapubic portion 410 can be positioned anywhere from the perineal and inner thigh regions (as shown in FIGS. 26 and 27) to the patient's pubic and lower abdominal regions. In any case, when the positioner 400 is evacuated, the positioner conforms to the shape of the patient's buttocks, perineal region, pubic region, and surrounding anatomy to provide a custom fit that spreads out contact forces more evenly and reduces pressure points.

As shown in FIGS. 24-27, the thigh straps 436 can help retain the suprapubic portion 410 of the positioner 400 in the upright position against the patient's perineal/pubic region 458 to form a physical stop that resists the gravitational forces that tend to pull the patient feet first off the table 450 when in an inclined position. The thigh straps 436 can supplement the intrinsic rigidity of the positioner 400 itself, which becomes significantly rigid when evacuated of air, as described above.

As shown in FIGS. 23 and 26, the positioner 400 can further comprise a valve system 490 coupled to the lower side 404 of the positioner 400 in the intermediate portion 408 or the suprapubic portion 410. The valve system 490 can comprise the exemplary valve system 201 shown in FIGS. 14 and 15, and/or the valve system 490 can comprise other mechanisms for regulating the flow of air in and out of the positioner 400.

With the table 450 in a flat position, the positioner 400 can be strapped to the table using the table straps 432, 433. Prior to evacuating air from inside the positioner 400, the suprapubic portion 410 can extend over the lower end of the table 450. After a patient is positioned on the torso portion 406 of the positioner with the patient's buttocks adjacent the lower end of the table 450 and the patient's legs placed in the stirrups 452, the suprapubic portion 410 can be folded up against the patient's perineal/pubic region 458. Subsequently, the air is evacuated from the positioner 400 via the valve system 490, making the positioner rigid. The thigh straps 436A, 436B extending from either side of the suprapubic portion 410 can then be wrapped around the patient's thighs or hips and attached to the strap segments 434A, 434B or to the strap segment 435. Alternatively, the thigh straps 436 can be secured around the thighs/hips before the air is evacuated from the positioner 400. The straps 436 can then be cinched or tightened sufficiently to keep the suprapubic portion 410 tightly secured against the patient's perineal/pubic region 458 and prevented from flexing downward under the patient's weight. The table 450 can then be inclined as shown in FIG. 25 to put the patient securely in a reverse Trendelenburg position.

Figure 22:
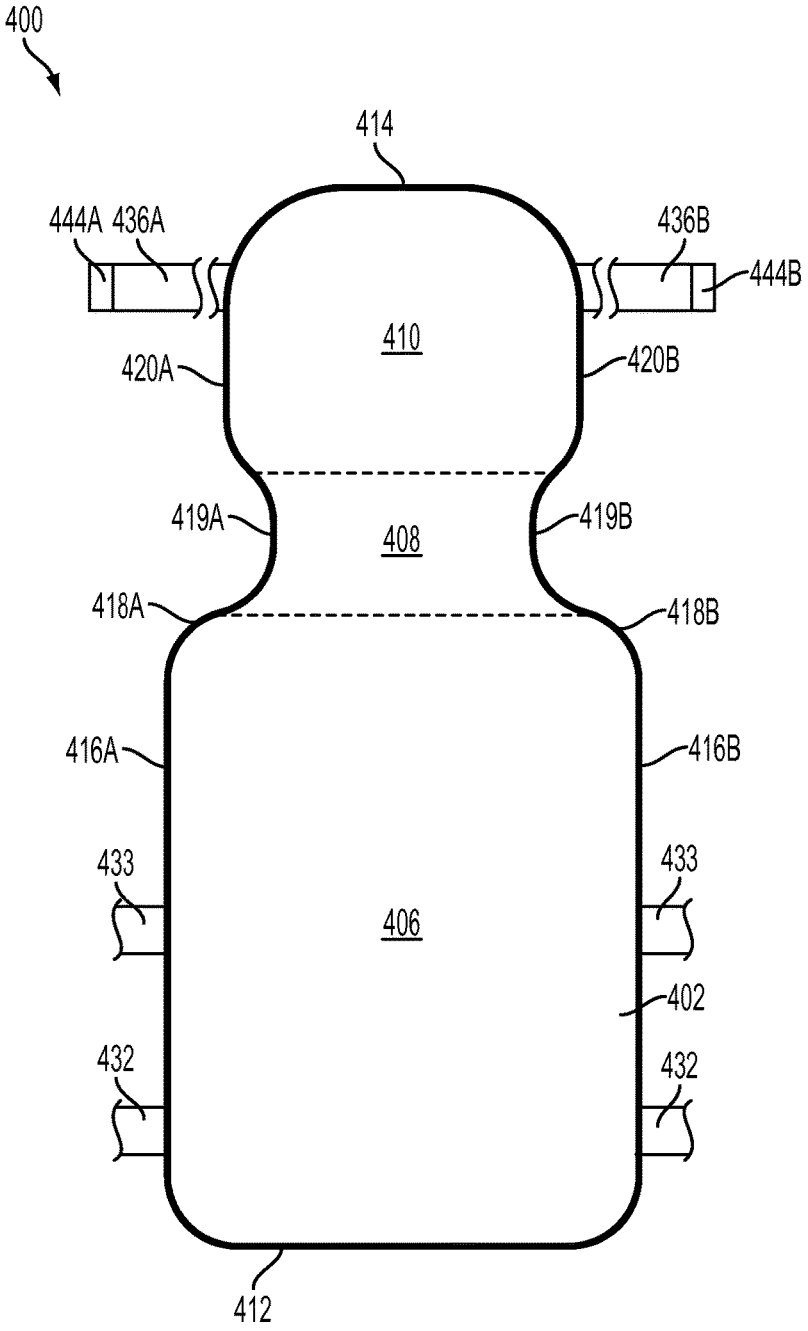
FIG. 22 shows an upper side of another exemplary embodiment of a patient positioner.

The torso portion 406 of the positioner 400 can comprise a width to fit a particular patient's body size. In some embodiments, the width of the torso portion 406 can be about 20 inches. The length of the torso portion 406 can be somewhat shorter than the patient's torso such that the superior end 412 is below the patient's neck. This can provide room around the shoulder and neck region for surgical equipment. The length of the torso portion 406 can be about 24 inches in some embodiments, and can depend on the length of the patient's torso. The width of the suprapubic portion 410 can be about 15 inches in some embodiments, and the width of the intermediate portion 408 can be about 11 inches at the narrowest point between the cutouts 419A, 419B. The overall length of the positioner 400 can be about 45 inches. The patches 430 can be about 8 inches long and about 4 inches wide. The straps can be about 2 inches wide and vary in length. All of the dimensions in this paragraph correspond to the not evacuated position of the positioner 400 as shown in FIGS. 22 and 23.

In use, the positioner 400 can be covered with a slip cover. Such a slip cover can cover most of the positioner, but have one or more openings that correspond to the portions of the lower surface 404 that includes the patches 430A-D and the valve 490. The straps 432, 433, 434, 435 and 436 and the valve 490 can extend through openings in the slip cover such that they can be operatively used with the slip cover on the positioner.

Some embodiment of the positioner 400 can further comprise any one or more of the various features disclosed herein with regard to the positioners 12, 112, and 300 shown in FIGS. 1-21.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the term "and/or" used between the last two of a list of elements means any one or more of the listed elements. For example, the phrase "A, B, and/or C" means "A," "B," "C," "A and B," "A and C," "B and C" or "A, B and C."

As used herein, the term "coupled" generally means mechanically, chemically, or otherwise physically coupled or linked and does not exclude the presence of intermediate elements between the coupled or associated items absent specific contrary language.

In view of the many possible embodiments to which the principles disclosed herein may be applied, it should be recognized that the illustrated embodiments are only preferred examples and should not be taken as limiting the scope of the disclosure. Rather, the scope of the disclosure is at least as broad as the following claims. We therefore claim all that comes within the scope and spirit of these claims.

I claim:

1. A positioner for positioning a patient in an inclined position, the positioner comprising:

a flexible, air-impermeable shell comprising an upper wall, a lower wall, and an enclosed internal region between the upper and lower walls, the upper wall configured to facilitate positioning the patient, a portion of the lower wall configured to rest against an inclined support surface;

a plurality of beads disposed in the internal region of the shell; and an air valve coupled to the shell and operable to regulate air flow in and out of the internal region of the shell, wherein the positioner is configured to rigidly conform to a shape of the patient upon evacuation of air from the shell;

the positioner having a torso portion configured to support the patient's torso and secure the positioner to the support surface, an intermediate portion integrally coupled to the torso portion, and a suprapubic portion integrally coupled to the intermediate portion opposite the torso portion and configured to extend up between the patient's legs and against the patient's pubic region when the shell is evacuated;

wherein the positioner is adjustable between an engaged position and a relaxed position, wherein in the relaxed position, sufficient air is permitted in the shell such that the suprapubic portion is lax and is articulable relative to the intermediate portion, and such that the suprapubic portion can be moved to and from a position extending up between the patient's legs and against the patient's pubic region, and wherein in the engaged position, the shell is evacuated of air, the beads in the shell engage together, and the suprapubic portion is rigidly held extending up between the patient's legs and against the patient's pubic region; and wherein, in the engaged position, the positioner is configured to hold the patient in an inclined position on the inclined support surface with the patient's head above the patient's hips such that the suprapubic portion physically blocks the patient from sliding down the inclined support surface; and the positioner further comprising a single strap coupled to the suprapubic portion, the single strap extending laterally in a left-right direction across the suprapubic portion, the single strap having a left end extending leftwardly from the suprapubic portion and a right end extending rightwardly from the suprapubic region, wherein when the positioner is in the engaged position the left end of the strap is configured to extend around a left portion of the patient and couple to the torso portion and the right end of the strap is configured to extend around a right portion of the patient and couple to the torso portion.

2. The positioner of claim 1, wherein the strap supports the suprapubic portion to keep the suprapubic portion positioned against the patient's pubic region.

3. The positioner of claim 2, wherein the torso portion comprises strap portions that extend from the torso portion at an angle between a left-right lateral axis and a superior-inferior axis, the strap portions being configured to be connected to the left and right ends of the single strap coupled to the suprapubic portion.

4. The positioner of claim 1, wherein the intermediate region comprises left and right lateral cutout portions and the intermediate region is narrower in a left-right direction than the torso portion and the suprapubic portion.

5. The positioner of claim 4, wherein the suprapubic portion is narrower in the left-right direction than the torso portion.

6. The positioner of claim 1, wherein the positioner is configured to hold the patient on an operating table in a reverse Trendelenburg position.

7. The positioner of claim 1, wherein the air valve is positioned at the intermediate portion and along the lower wall of the shell.

8. The positioner of claim 1, wherein the torso portion comprises one or more table straps for securing the positioner to the support surface.

9. The positioner of claim 1, wherein the torso portion comprises a plurality of strap patches, each strap patch securing at least one strap to the torso portion.

* * * * *